US011492743B2

(12) United States Patent
Chae et al.

(10) Patent No.: US 11,492,743 B2
(45) Date of Patent: Nov. 8, 2022

(54) WASHING MACHINE AND CONTROL METHOD THEREOF

(71) Applicant: LG Electronics Inc., Seoul (KR)

(72) Inventors: Kyosoon Chae, Seoul (KR); Hyundong Kim, Seoul (KR); Sooyoung Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 190 days.

(21) Appl. No.: 16/845,998

(22) Filed: Apr. 10, 2020

(65) Prior Publication Data

US 2020/0325613 A1 Oct. 15, 2020

(30) Foreign Application Priority Data

Apr. 12, 2019 (KR) ..... 10-2019-0042785

(51) Int. Cl.
*D06F 34/14* (2020.01)
*D06F 33/37* (2020.01)
(Continued)

(52) U.S. Cl.
CPC ..... *D06F 34/14* (2020.02); *D06F 33/37* (2020.02); *D06F 39/022* (2013.01); *D06F 2103/22* (2020.02); *D06F 2105/42* (2020.02)

(58) Field of Classification Search
CPC ..... D06F 33/37; D06F 33/57; D06F 34/18; D06F 39/02; D06F 39/022; D06F 2103/22; D06F 2105/42
See application file for complete search history.

(56) References Cited

U.S. PATENT DOCUMENTS

2006/0254626 A1* 11/2006 Botts ..... A47L 15/0055 68/17 R
2009/0288453 A1* 11/2009 Lee ..... D06F 39/022 68/17 R
(Continued)

FOREIGN PATENT DOCUMENTS

EP 2733249 5/2014
EP 2521811 B1 3/2015
(Continued)

OTHER PUBLICATIONS

Machine translation of KR 1020150103988 to LG Electronics. (Year: 2015).*
(Continued)

*Primary Examiner* — Joseph L. Perrin
(74) *Attorney, Agent, or Firm* — Fish & Richardson P.C.

(57) ABSTRACT

A method for controlling a washing machine includes: detecting a first sensor value by a first set of electrode sensors and a second sensor value by a second set of electrode sensors having at least one electrode sensor which is placed vertically higher than the first set of electrode sensors, the first and second set of electrode sensors comprising at least three electrode sensors which are located at least one of cartridges and configured to detect an amount of detergent contained in the at least one the cartridges; comparing the first sensor value and the second sensor value with a first predetermined value, respectively; passing a predetermined time; redetecting the first sensor value and the second sensor value and calculating a difference sensor value; and determining that the detergent is filling to a height between the first set of electrode sensors and the second set of electrode sensors.

13 Claims, 21 Drawing Sheets

(51) Int. Cl.

| | |
|---|---|
| ***D06F 39/02*** | (2006.01) |
| ***D06F 105/42*** | (2020.01) |
| ***D06F 103/22*** | (2020.01) |

(56) References Cited

U.S. PATENT DOCUMENTS

| | | | | |
|---|---|---|---|---|
| 2010/0000578 | A1* | 1/2010 | Hendrickson | D06F 39/022 68/12.18 |
| 2010/0161143 | A1 | 6/2010 | Smith et al. | |
| 2011/0154864 | A1* | 6/2011 | Schulze | F16K 11/0743 68/17 R |
| 2012/0152290 | A1* | 6/2012 | Brosnan | D06F 33/37 134/115 R |
| 2015/0252513 | A1* | 9/2015 | Seo | D06F 33/37 68/17 R |
| 2017/0127905 | A1* | 5/2017 | DeWeerd | A47L 15/4445 |
| 2019/0153648 | A1* | 5/2019 | Clayton | D06F 37/266 |

FOREIGN PATENT DOCUMENTS

| | | | |
|---|---|---|---|
| JP | 2018011618 | | 1/2018 |
| JP | 2019037722 | | 3/2019 |
| KR | 1019990074113 | | 10/1999 |
| KR | 1020090122003 | | 11/2009 |
| KR | 1020110004748 | | 1/2011 |
| KR | 1020110099288 | | 9/2011 |
| KR | 1020130062271 | | 6/2013 |
| KR | 1020140071560 | | 6/2014 |
| KR | 1020150103988 | * | 9/2015 |
| KR | 1020170063107 | | 6/2017 |
| WO | WO2009142354 | | 11/2009 |

OTHER PUBLICATIONS

European Extended Search Report in European Patent Appln. No. 20169287.8, dated Aug. 21, 2020, 8 pages.

PCT International Search Report in International Appln. No. PCT/KR2020/004918, dated Jul. 31, 2020, 3 pages.

* cited by examiner

FIG. 18

| SENSOR DETECTION STATUS | | DETERMINATION |
|---|---|---|
| FIRST SENSOR VALUE | SECOND SENSOR VALUE | |
| X | X | EMPTY OR UNMOUNTED |
| X | O | MALFUNCTION |
| O | X | LACK OF DETERGENT |
| O | O | NORMAL |

WASHING MACHINE AND CONTROL METHOD THEREOF

CROSS-REFERENCE TO RELATED APPLICATION

This application claims the benefit of priority to Korean Application No. 10-2019-0042785, filed on Apr. 12, 2019, the disclosure of which is incorporated by reference in its entirety.

BACKGROUND

Field

The present disclosure relates to a washing machine and control method thereof, and more particularly, to a washing machine capable of automatically providing the washing machine with various detergents.

Related Art

A washing machine is a device handling laundry through washing, dehydration and/or drying and the like. The washing machine is a device removing contamination of a laundry by using water and detergents.

Recently, there is a need to develop a device automatically mixing and providing various detergents according to various laundries, so technical features related therewith are under development.

During supplying various detergents, it is necessarily required to employ detecting function to let user refill detergent in case of lack of detergent in a cartridge.

U.S. Patent Publication No. 2010/0161143 A1 discloses detecting residual amount of detergent in the cartridge with a pair of sensors. However, in case of using a pair of sensors, there may be a problem that the sensor is electrified because the sensor is swayed by an external force even though lack of detergent, and a problem that the sensor is electrified because detergent is exposed to air so that the detergent is harden on the sensor. As the result of the foregoing, there may be a malfunction of the sensor detecting residual quantity of detergent.

SUMMARY

One object of the present disclosure is to provide a washing machine capable of precisely detecting a residual amount of detergent contained in a cartridge.

Another object of the present disclosure is to provide a washing machine capable of determining whether a cartridge is properly mounted or malfunctioned, or a cartridge sensor is malfunctioned or something.

Objects of the present disclosure should not be limited to the aforementioned objects and other unmentioned objects will be clearly understood by those skilled in the art from the following description.

In accordance with an embodiment of the present disclosure, the above and other objects can be accomplished by the provision of washing machine including a cabinet, a tub disposed in the cabinet so as to receive water, a drum rotatably disposed in the tub so as to accommodate a laundry and a detergent supply device disposed at the cabinet so as to supply detergent contained in a plurality of cartridges into the tub, the method including the steps of (a) detecting a first sensor value by a first two electrode sensors and a second sensor value by a second two electrode sensors having at least one electrode sensor which is placed at a higher position than the first two electrode sensors, the first and second two electrode sensors comprising at least three electrode sensors which are installed at at least one of the cartridges to detect an amount of detergent contained in a corresponding one of the plurality of cartridges, (b) comparing the first sensor value and the second sensor value with a first predetermined value, (c) passing a predetermined time when each of the first sensor value and the second sensor value is less than the first predetermined value, (d) redetecting the first sensor value and the second sensor value, and calculating a difference sensor value after the predetermined time is passed and (e) determining that detergent is filling to a height between the first two electrode sensors and the second two electrode sensors, when the difference value is greater than a second predetermined value after the predetermined time is passed.

The control method may further comprise determining that at least one of the electrode sensors is a malfunctioned, when the first sensor value is greater than the first predetermined value and the second sensor value is less than the first predetermined value.

The control method may further comprise determining that detergent is filling to a lower height than the first two electrode sensors, when each of the first sensor value and the second sensor value is greater than the first predetermined value.

The control method may further comprise determining that detergent is filling to a height between the first two electrode sensors and the second two electrode sensors, when the first sensor value is less than the first predetermined value and the second sensor value is greater than the first predetermined value.

The control method may further comprise determining that detergent is filling to a higher height than the second two electrode sensors, when the difference value is less than the second predetermined value.

The first and second two electrode sensors may comprise three electrode sensors, wherein the three electrode sensors include a first and second electrode sensors having a first height and a third electrode sensor having a height higher than the first height, wherein the first two electrode sensors comprises the first and second electrode sensors, and the second two electrode sensors comprises the first electrode sensor or the second electrode sensor and the third electrode sensor; and wherein the height between the first two electrode sensors and the second two electrode sensors is a height between the first or second electrode sensor and the third electrode sensor.

The control method may further comprise determining that detergent is filling to a lower height than the first two electrode sensors, when each of the first sensor value and the second sensor value is greater than the first predetermined value.

The control method may further comprise determining that detergent is filling to a height between the first two electrode sensors and the third electrode sensor, when the first sensor value is less than the first predetermined value and the second sensor value is greater than the first predetermined value.

The step (d) may further comprise determining that detergent is filling to a higher position than the at least one electrode sensor, when the difference value is less than the second predetermined value.

The washing machine may comprise a cabinet, a tub disposed in the cabinet so as to receive water, a drum rotatably disposed in the tub, the drum containing laundry, and a detergent supply device disposed at the cabinet to supply detergent into the tub, the detergent supply device comprising a plurality of cartridges containing detergent, a passage switching valve connecting to at least one of the plurality of cartridges, a pump connected to the at least one cartridge via the passage switching valve to pump detergent contained in the at least one cartridge to the tub and a passage guiding the detergent suctioned by the pump into the tub, wherein at least three electrode sensors are installed at each of the at least one of the plurality of cartridges, wherein at least one electrode sensor of the at least three electrode sensors has a different height from those of the other electrode sensors.

The detergent supply device may further comprise a housing accommodating the one of cartridges, wherein the electrode sensors are installed at a rear wall of the housing.

Each of the electrode sensors may comprise an electrode plate and a terminal connected to the electrode plate to transmit an electric signal.

An opening for the electrode plate may be formed at a rear surface of the at least one cartridge so that detergent contained in the at least one cartridge is contacted to the electrode plate.

The washing machine including the same according to the present disclosure provide at least the following effects.

First, the washing machine according to an exemplary embodiment of the present disclosure has an advantage of minimizing a misjudgment of an electrode sensor due to detergent hardened on the electrode sensor even in a case that a cartridge is not filled with enough detergent.

Second, the washing machine according to an exemplary embodiment of the present disclosure has an advantage of minimizing a misjudgment of an electrode sensor due to a inclined electrode sensor or sway of the electrode sensor even in a case that a cartridge is not filled with enough detergent.

Third, the washing machine according to an exemplary embodiment of the present disclosure has an advantage of determining whether an electrode sensor for detecting a residual amount of detergent is malfunctioned.

Fourth, the washing machine according to an exemplary embodiment of the present disclosure has an advantage of determining whether a cartridge is empty or unmounted without a need for installing an additional sensor.

It should be understood that advantageous effects according to the present disclosure are not limited to the effects set forth above and other advantageous effects of the present disclosure will be apparent from the detailed description of the present disclosure.

Details of other embodiments will be described in the detailed description with reference to the accompanying drawings.

BRIEF DESCRIPTION OF THE DRAWINGS

FIG. 18 is a diagram indicating a result of detecting of sensor according to an exemplary embodiment of the present disclosure.

DESCRIPTION OF EXEMPLARY EMBODIMENTS

Figure 1:
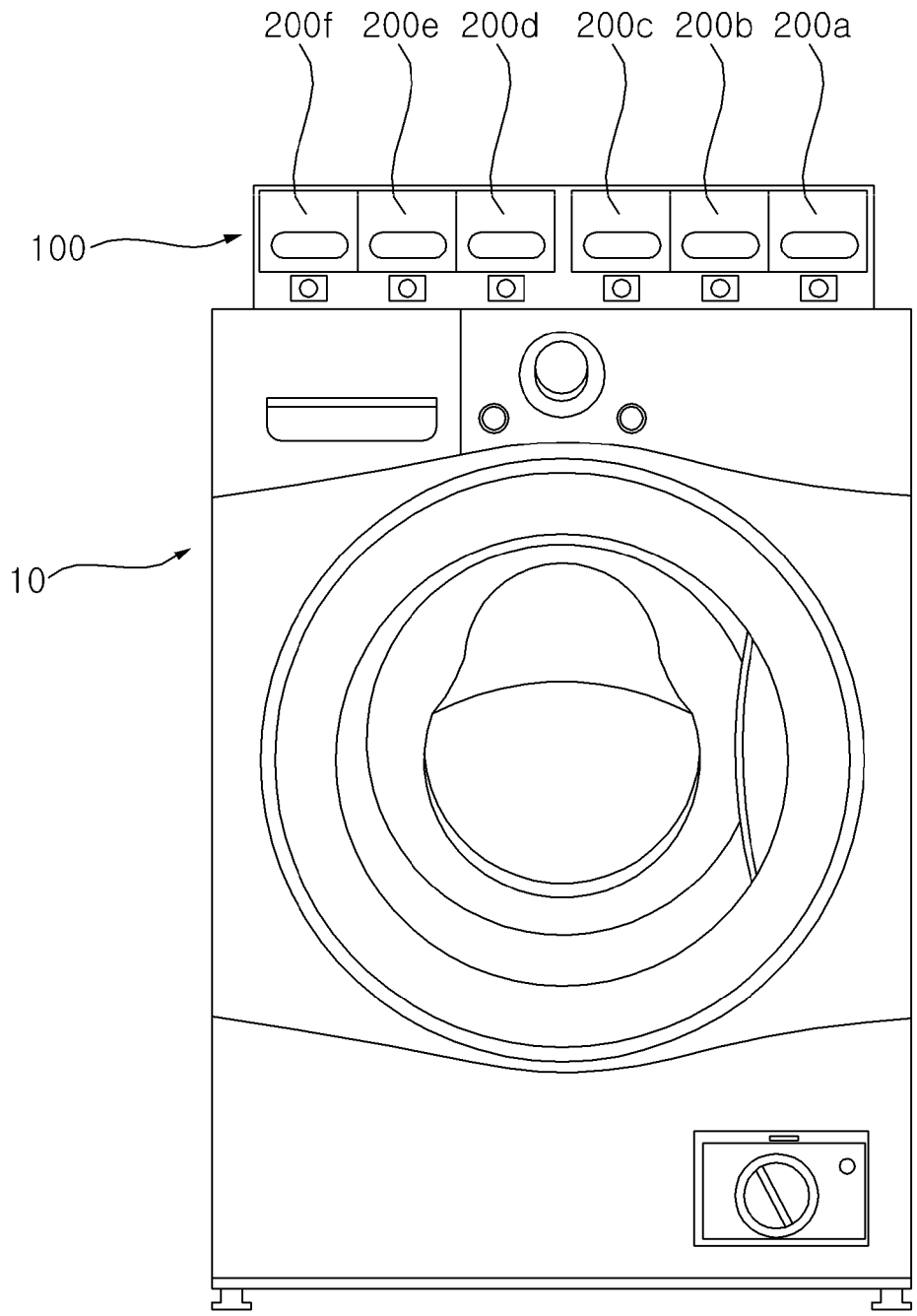
FIG. 1 is a front view of a washing machine according to an exemplary embodiment of the present disclosure.

Advantages and features of the present disclosure and methods of achieving the advantages and features will be apparent with reference to embodiments described below in detail in conjunction with the accompanying drawings. However, the present disclosure is not limited to embodiments disclosed below, but may be implemented in various forms, only the present embodiments are provided so that a disclosure of the present disclosure is complete and a disclosure of a scope of the present application is fully understood by those skilled in the art to which the present disclosure belongs, and the present disclosure is only defined by the scope of the claims. The same reference numerals indicate the same components through the specification.

Hereinafter, the present disclosure will be more specifically described with reference the accompanying drawings.

Figure 2:
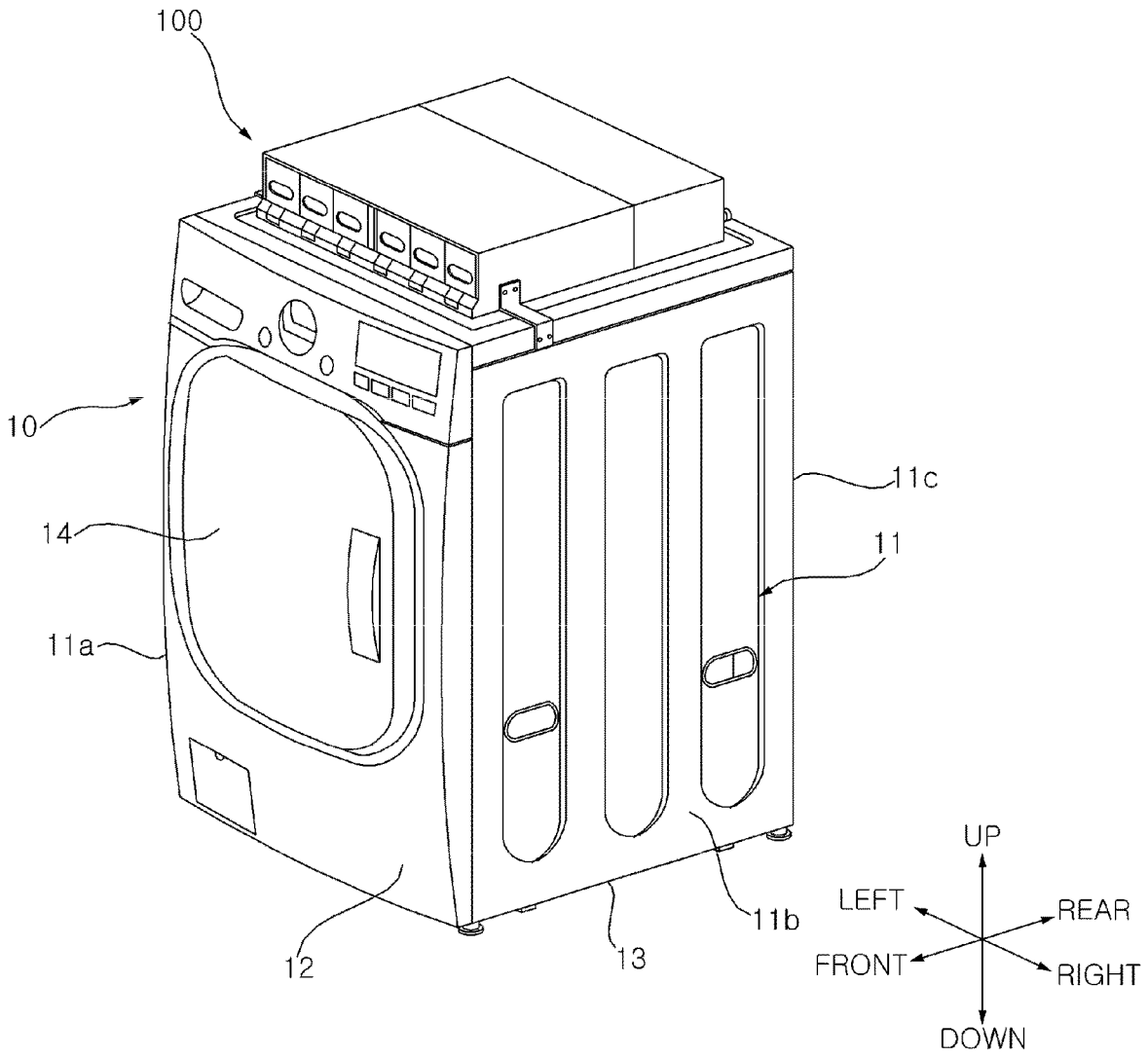
FIG. 2 is a perspective view of a washing machine according to an exemplary embodiment of the present disclosure.
Figure 3:
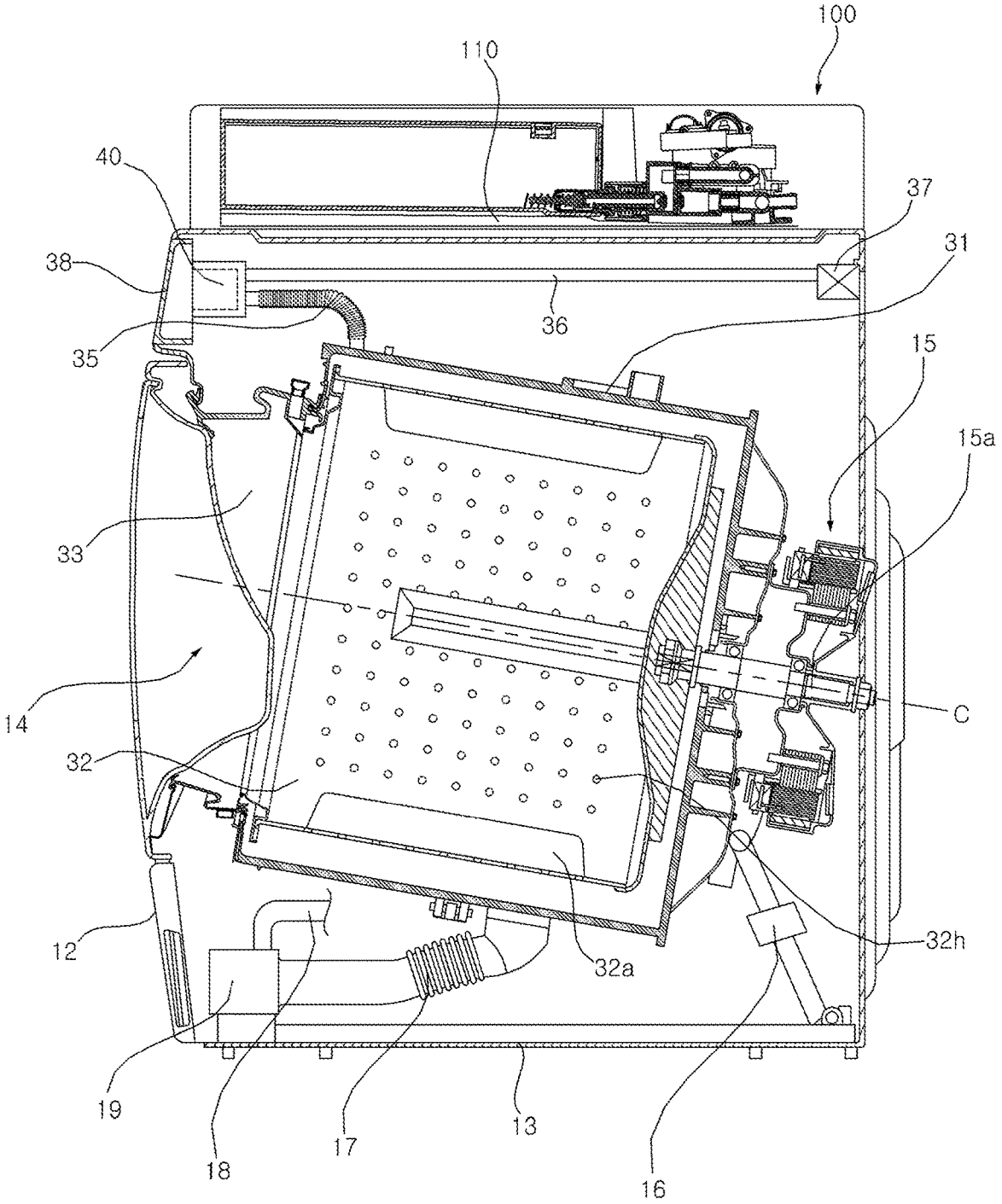
FIG. 3 is a lateral cross-sectional view of a washing machine according to an exemplary embodiment of the present disclosure.
Figure 4:
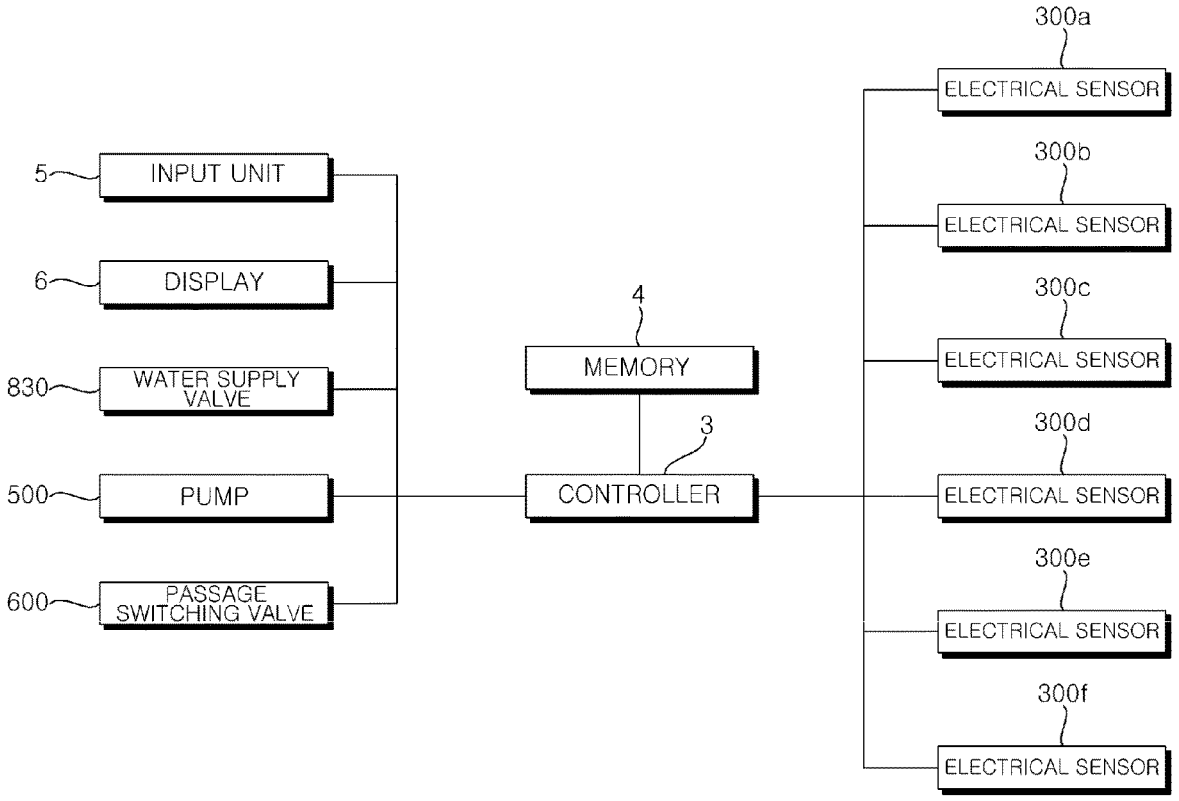
FIG. 4 is a flow chart of a washing machine according to an exemplary embodiment of the present disclosure.
Figure 5:
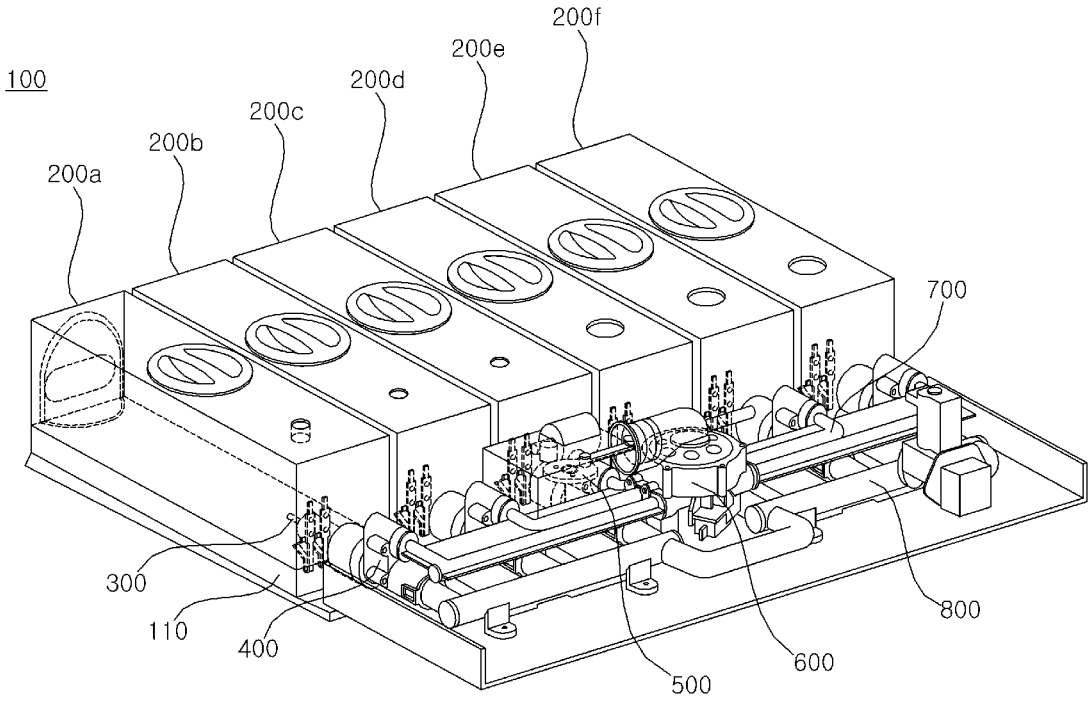
FIG. 5 is a schematic view of a detergent supply device according to an exemplary embodiment of the present disclosure.
Figure 6:
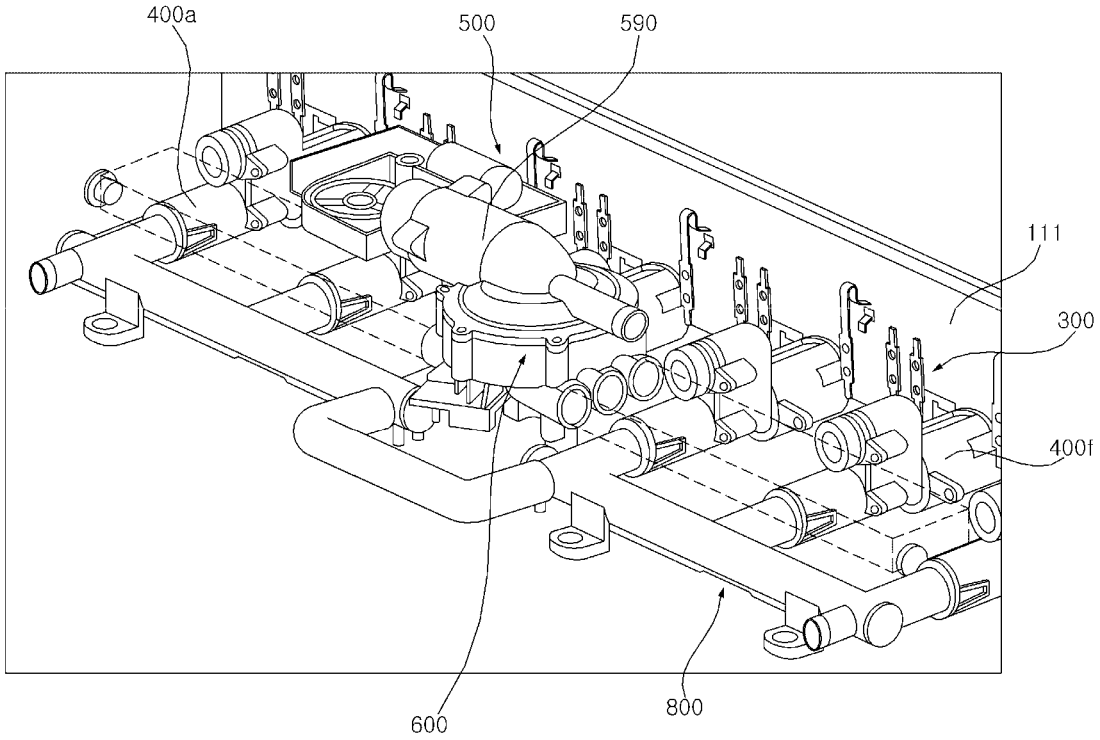
FIG. 6 is a schematic view showing a rear side of a detergent supply device according to an exemplary embodiment of the present disclosure.
Figure 7:
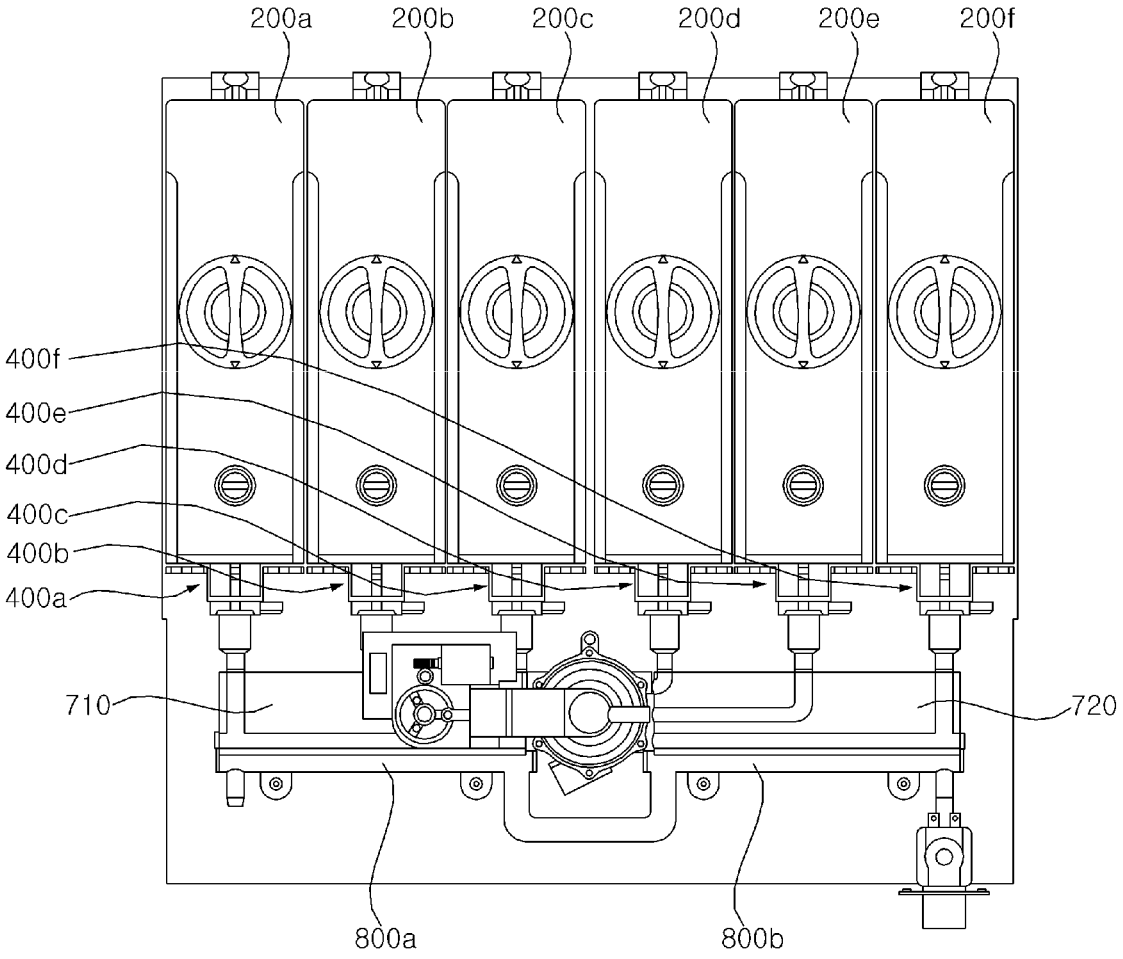
FIG. 7 is a schematic view of a detergent supply device viewed from above.
Figure 8:
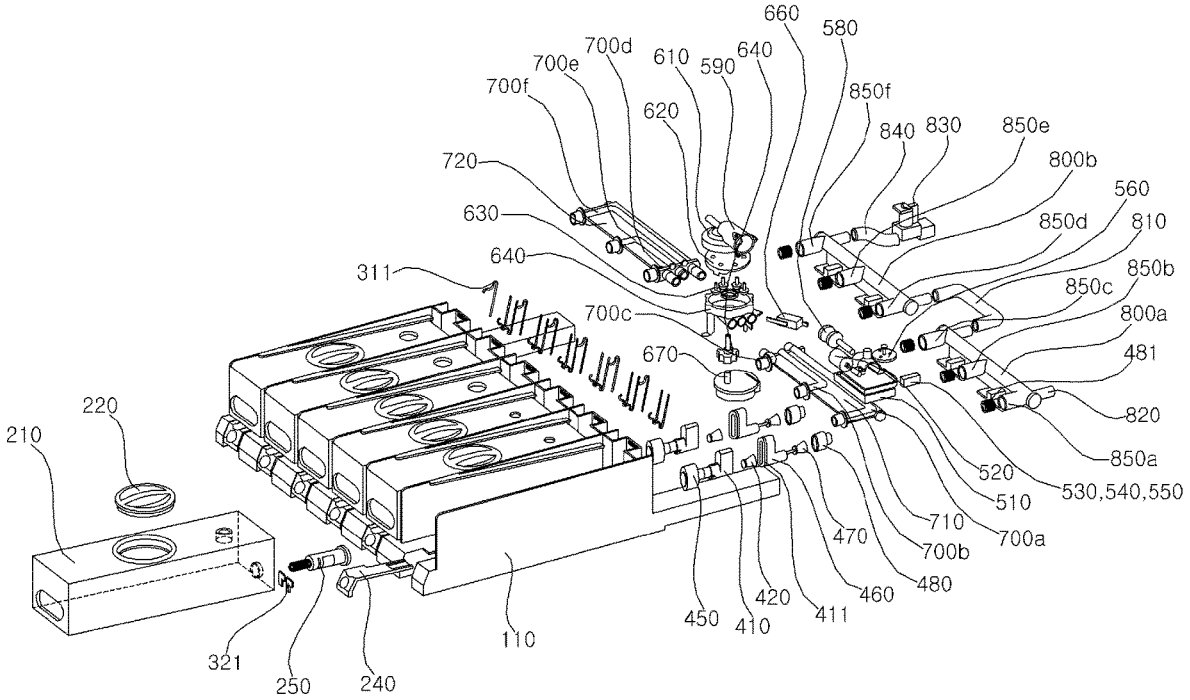
FIG. 8 is an exploded perspective view of a detergent supply device according to an exemplary embodiment of the present disclosure.
Figure 9:
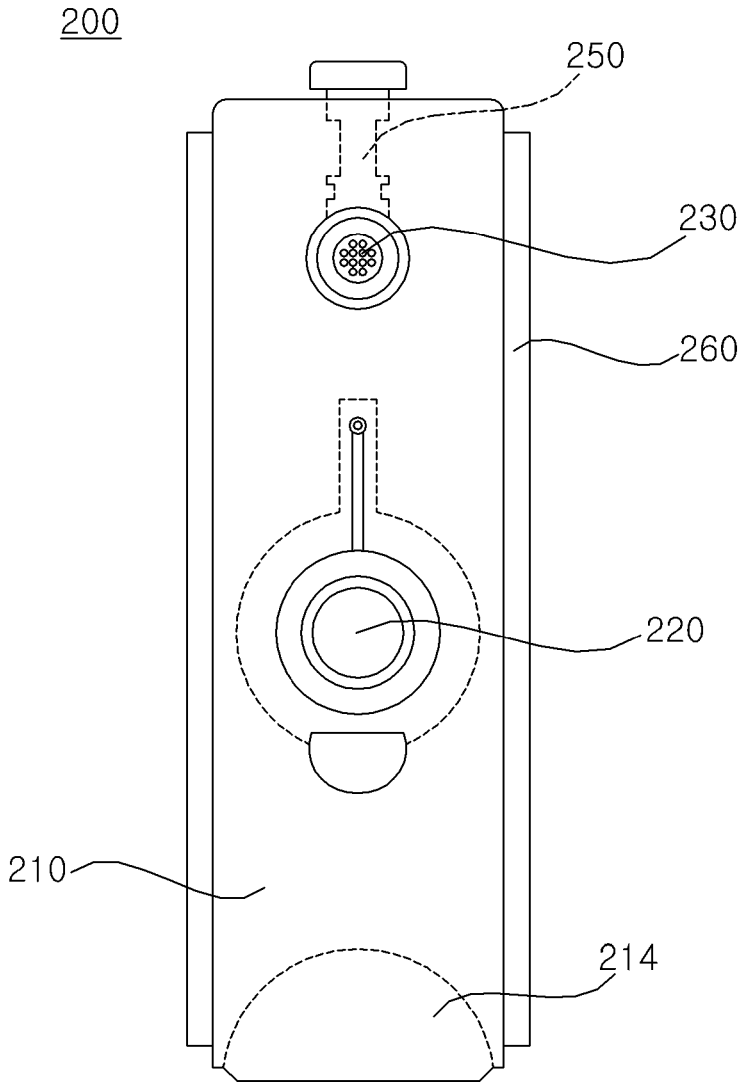
FIG. 9 is a schematic view of a cartridge of a detergent supply device according to an exemplary embodiment of the present disclosure.

Referring to FIG. 1 through FIG. 3, a washing machine according to an exemplary embodiment of the present disclosure includes a cabinet 10 and a detergent supply device 100 disposed at an upper surface of the cabinet 10.

The cabinet 10 is formed as an appearance of a washing machine, and a tub 31 and a drum 32 are disposed in the cabinet 10. The cabinet 10 includes a main frame 11 having a front surface opened, a left surface 11*a*, a right surface 11*b* and rear surface 11*c*, a front panel 12 having a loading/unloading opening and connected to the front surface of the main frame 11, and a planar base 13 supporting the main frame 11 and the front panel 12 from the below. A door 14 opening and closing the loading/unloading opening is mounted rotatably to the front panel 12.

The front panel 12 and the tub 31 are communicated to each other with a circular gasket 33. A frontal end portion of the gasket 33 is mounted at the front panel 12, a rear end portion of the gasket 33 is mounted fixedly along a circumference of an inlet of the tub 31. The gasket 33 is formed as a material having elasticity and capable of preventing water in the tub 31 from leaking.

A driving portion 15 is disposed at a rear side of the drum 32 so as to rotate the drum. Further, there may be provided with a water supply hose (not shown) guiding water supplied from an external water source and a water supply portion 37 controlling water supplied from the water supply hose to a water supply passage 36. The water supply portion 37 may include a water supply valve (not shown) opening/closing the water supply passage 36.

The cabinet 10 includes a drawer 38 accommodating detergent and a drawer housing 40 accommodating the drawer 38 so that the drawer 38 is withdrawable therefrom. The detergent may also include bleach or fabric softener as well as detergent for laundry. Detergent accommodated in the drawer 38 is provided to the tub 31 through a water supply bellows 35 when water is supplied through the water supply passage 36. A water supply hole (not shown) connected to the water supply bellows 35 may be disposed at a side of the tub 31.

The tub 31 may include a drain discharging water, and a drain bellows 17 may be connected to the drain. A drain pump 19 pumping water discharged from the tub 31 through the drain bellows 17 so as to discharge the water to the outside of the washing machine.

Hereinafter, a water supply device 100 mounted at an upper surface of the cabinet according to an exemplary embodiment of the present disclosure will be described.

Referring to FIG. 1 through FIG. 8, the water supply device 100 includes a housing 110 having a door disposed at a front side thereof and defining an accommodating room inside thereof, and a cover 120 opening and closing the housing 110.

An opening formed as a rectangular cuboid made of various surfaces is disposed at a front side of the housing 110, and each of the opening is extended from a rear side of the housing 110 so as to form a room for a cartridge corresponding to each of the opening. That is, each of a plurality of cartridges 200, 200*b*, 200*c*, 20*d*, 200*e*, 200*f* (hereinafter referred to as "200") may be inserted to each opening room.

Detergent is accommodated in each of the cartridges 200, and preferably each detergent may have differential composition ratio. Although the number of cartridges according to an exemplary embodiment of the present disclosure may be six, the number of the cartridges are not limited to any particular number, and it is preferable to employ three cartridges or more.

An accommodating room for accommodating passages 700, 800, a passage switching valve 600 and detergent supply parts such as a pump 500 etc., may be disposed at a rear room of an accommodating room for the cartridge 200. A rear wall 111 are disposed between the accommodating room for the cartridge and the accommodating room for the accommodating room, and further a terminal and an electrode sensor 300 is installed at the rear walls.

The pump 500 and the passage switching valve 600 may be controlled by a controller 3. Information about contents of detergent and various composition ratio of contents may be stored in a memory 4. One of the contents is accommodated in each of the cartridges 200, and the controller 3 controls the pump 500 and the passage switching valve 600 according to information stored in the memory 4.

The washing machine may further include an input unit 5 for obtaining various control command related with an operation of the washing machine from a user. The input unit 5 may be disposed at an upper side of the front panel 12. A display 6 indicating the operating status of the washing machine may be disposed at the front panel 12.

The controller 3 may select a type of detergent from the memory 4 according to an input value that a user had input with the input unit 5, and the controller 3 may identify information about the detergent. And then, the controller 3 may control the pump 500 and the passage switching valve 600 so as to eject the selected detergent. Thus, the controller 3 may control the pump 500 corresponding to the cartridge 200 accommodating the selected detergent according to the composition ratio and the passage switching valve 600.

Hereinafter, referring to FIG. 5 through FIG. 8 and FIG. 9, cartridges 200 according to an exemplary embodiment of the present disclosure will be described.

The cartridges 200 may include a cartridge body 210 accommodating detergent, a detergent inlet 211 for injecting detergent into the cartridge bodies, a cap 220 for opening and closing the detergent inlet 211, a membrane 230 allowing air in the cartridges to flow to the outdoor, a cartridge locker 240 allowing the cartridges 200 to fixedly connect to the housing 110 in a case that the cartridges are inserted to the housing 110, a docking valve 250 connecting a check valve 400 and the cartridges 200 and a rib 260 preventing detergent from being contacted to the membrane 230.

The cartridge body 210 may be formed such as being corresponded to the appearance of the housing 110 so that the cartridge body 210 is snugly inserted to the accommodating room disposed at a front side of the housing 110. According to an exemplary embodiment of the present disclosure, the cartridge accommodator takes the form of rectangular, and also the cartridge 200 takes the form of rectangular corresponding to the appearance of the cartridge accommodator, and further the cartridge accommodators may have rounded corner so as to reduce abrasion occurred during assembling and disassembling of the cartridge 200.

The detergent inlet 211 may be disposed at a front side of the cartridge body 210, and a cap 220 opening and closing the detergent inlet 211 is disposed at the detergent inlet 211. When it is required to put detergent into the washing machine, detergent is put into the cartridge body 210 through the cap 220 opened. And then, the cap 220 must be closed after finishing putting detergent therein so as to prevent detergent from being discharged to outdoor.

The membrane 230 allowing the air of the cartridge to flow to the outdoor may be mounted at a frontal upper side of the cartridge body 210. The membrane 230 may keep a pressure of the cartridge and an external pressure the same so as to prevent detergent of the cartridge from supplying to the check valve inadvertently. Further, it is impossible for liquid-phase detergent to discharge to the outdoor through the membrane 230, so it is possible to prevent detergent from being harden by evaporation.

The cartridge locker 240 is disposed at a front surface of the cartridge accommodator 110 and a lower side of the cartridge. The cartridge locker 240 may secure the cartridge 200 for preventing the cartridge from being disassembled when the cartridge is snugly inserted thereto.

The docking valve 250 is disposed between a check valve assembly 400 and the cartridge 200 so as to connect the check valve assembly 400 with the cartridge, and so detergent of the cartridge may be supplied to an inlet passage 700 or an outlet passage 800 through the check valve assembly 400.

The rib 260 is mounted at the both sides of the cartridge body 210 so as to function as a guide allowing the cartridge 200 to be inserted into the cartridge accommodator 110 easily, and further the rib 260 may allow the cartridge body 210 to be arranged slantly so that detergent is not contacted to the membrane 230 in a case that the cartridge is leaned.

Hereinafter, referring to FIG. 5 through FIG. 8 and FIG. 10, structure and operation of an electric sensor 300 disposed at a rear side of the cartridge will be described.

Electric sensors 300*a*, 300*b*, 300*c*, 300*d*, 300*e*, 300*f* are respectively disposed correspondingly to six cartridges 200*a*, 200*b*, 200*c*, 200*d*, 200*e*, 200*f*. Each of the electrode sensors may include first electrode sensor, second electrode sensor and third electrode sensor so as to be corresponded to each of the cartridges.

Each of the first electrode sensors may include first terminal and first electrode plate, each of the second electrode sensors may include second terminal and second electrode plate, and each of the third electrode sensors may include third terminals and third electrode plate in the same manner.

Hereinafter, an electric sensor 300*a* installed at one cartridge 200*a* of the six cartridges will be described.

Figure 10:
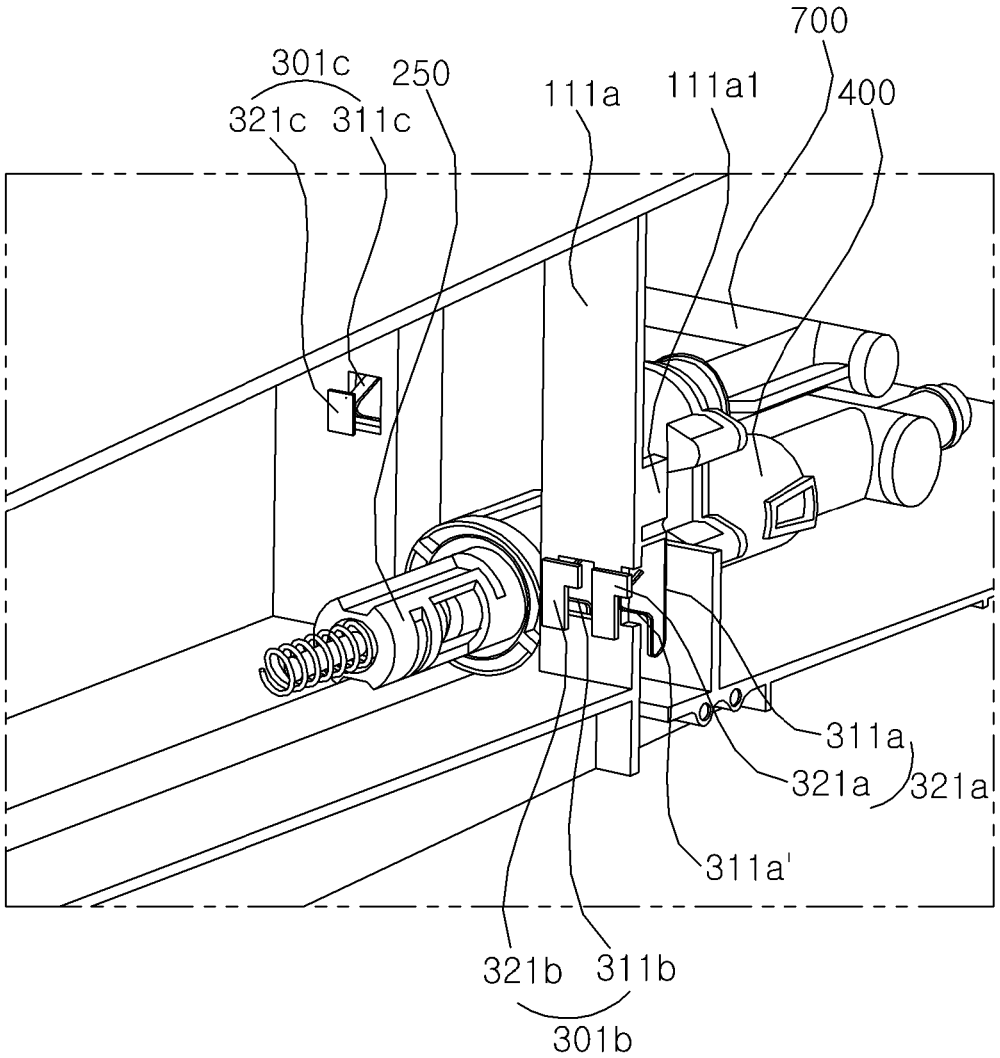
FIG. 10 is a schematic view showing an electrode sensor of a detergent supply device according to an exemplary embodiment of the present disclosure.
Figure 11:
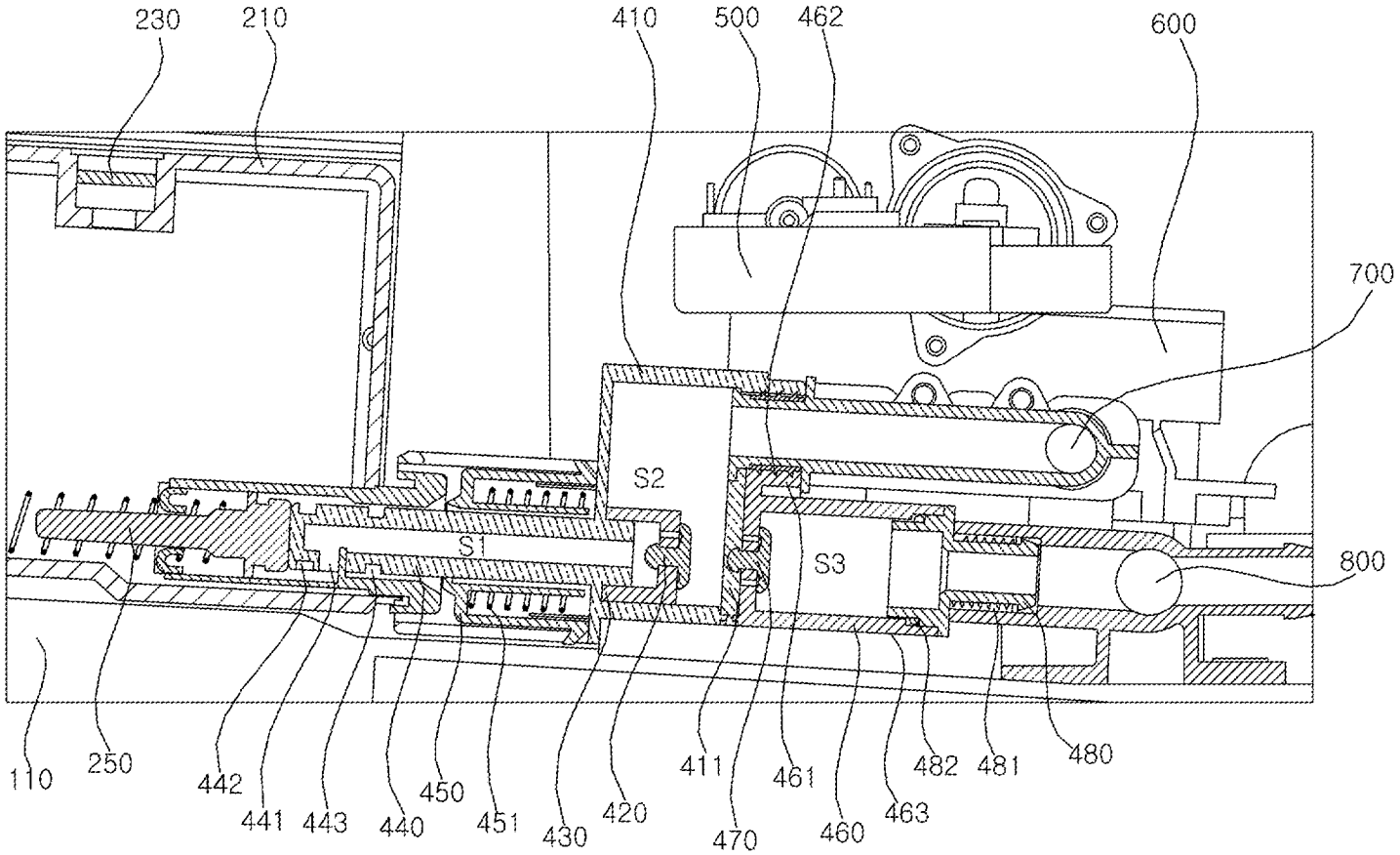
FIG. 11 is a schematic view showing an electrode sensor of a detergent supply device according to an exemplary embodiment of the present disclosure.
Figure 12:
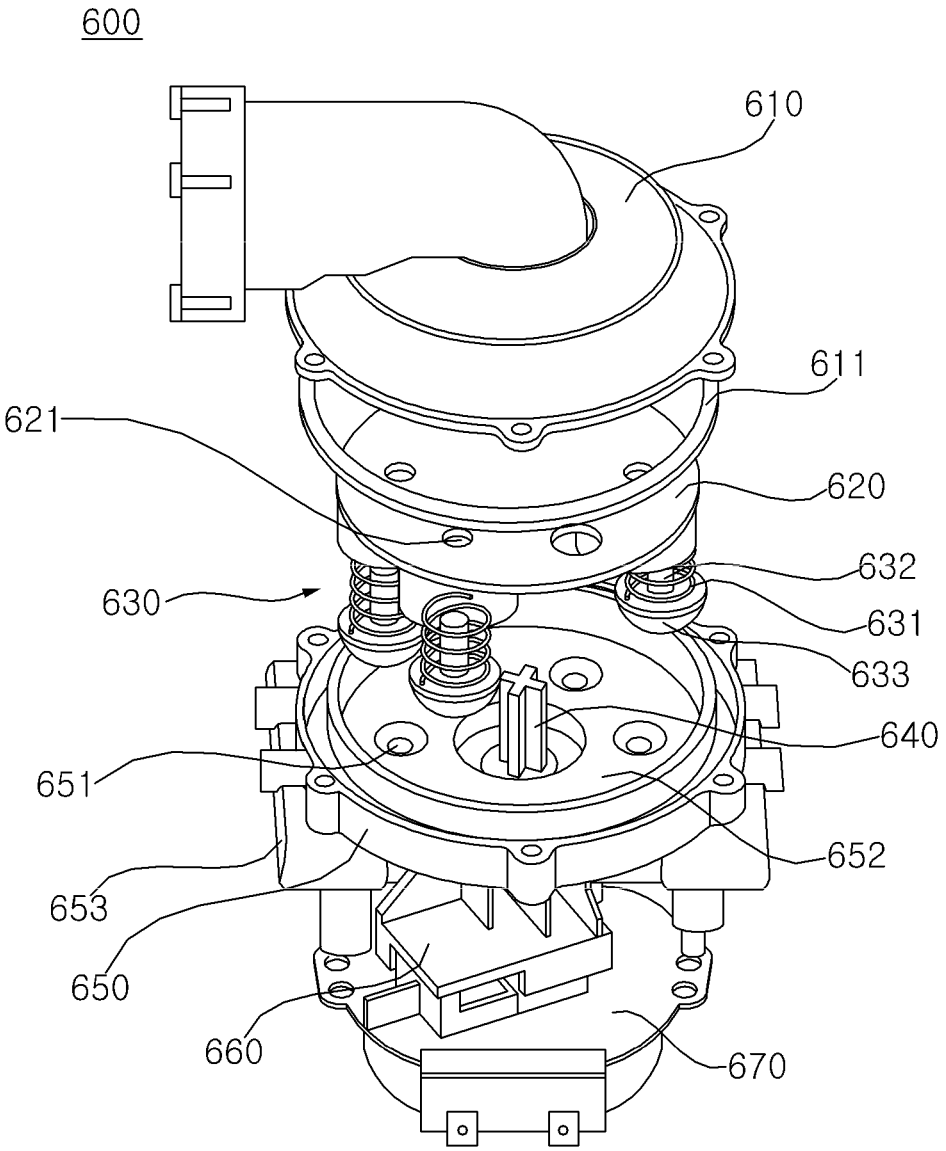
FIG. 12 is a schematic view showing a passage switching valve according to an exemplary embodiment of the present disclosure.
Figure 13:
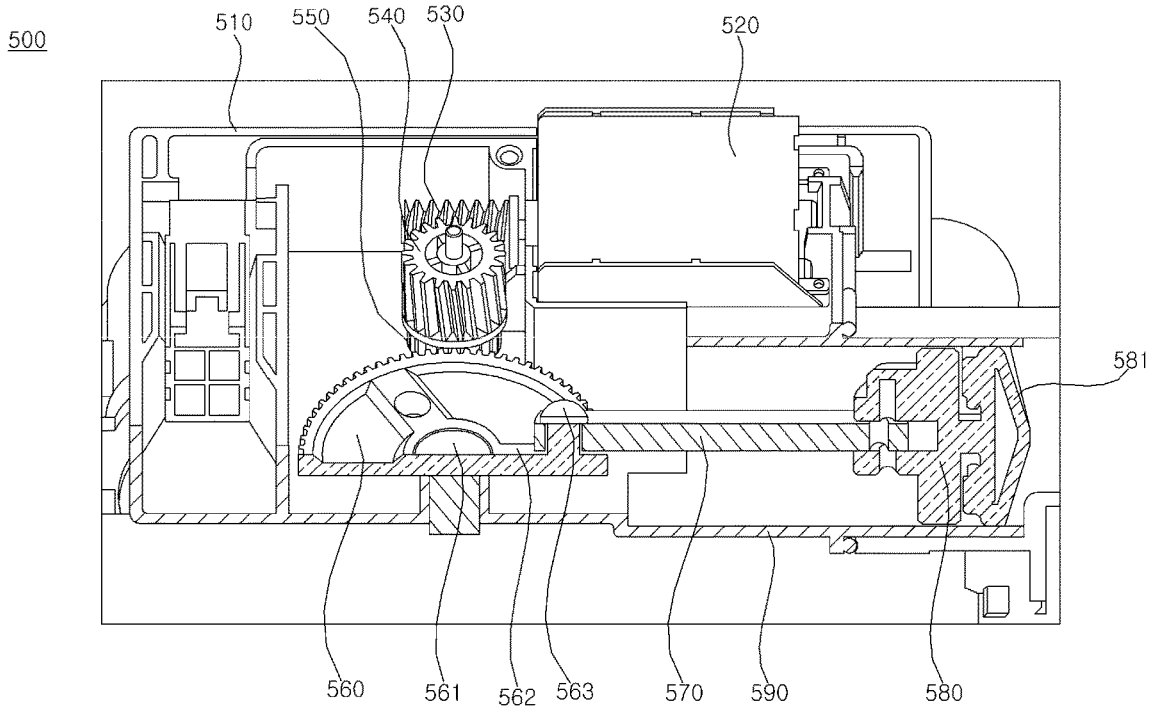
FIG. 13 is a schematic view showing a pump of a detergent supply device according to an exemplary embodiment of the present disclosure.
Figure 14:
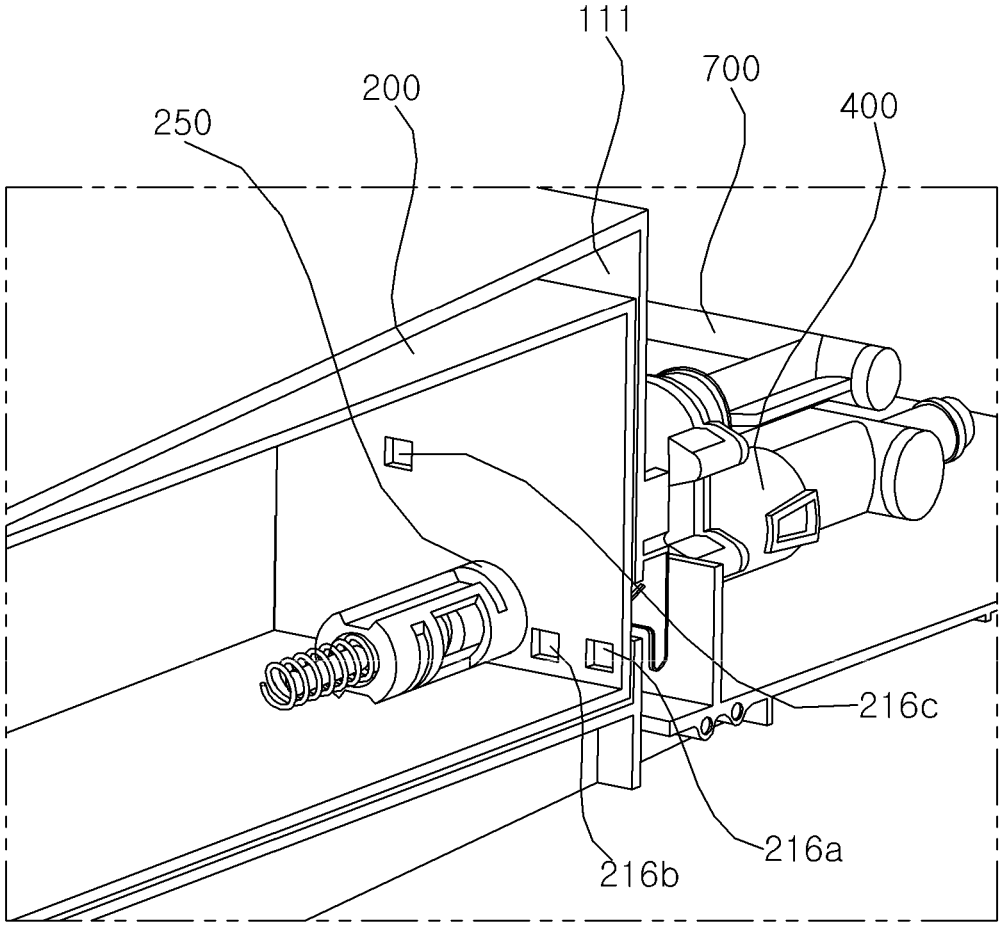
FIG. 14 is a schematic view showing a state that a cartridge is inserted in the structure shown in FIG. 10.

Referring to FIG. 10 and FIG. 14, the electric sensor includes the first electrode sensor 301*a*, the second electrode sensor 301*b*, and the third electrode sensor 301*c*.

The first electrode sensor 301*a* includes the first terminal 311*a* and the first electrode plate 321*a*.

The second electrode sensor 301*b* includes the second terminal 311*b* and the second electrode plate 321*b*.

The third electrode sensor 301*c* includes the third terminal 311*c* and the third electrode plate 321*c*.

The electrode sensor is mounted at the rear wall 111*a* of a housing 110 disposed at a rear side of the inserted cartridge 200. Specifically, the electrode plate 321 is installed between the rear wall 111*a* of the housing 110 and a rear side of the cartridge body 210, and the terminal 311 is mounted at a rear wall protrusion 111*a*1 protruding in a direction opposite to the rear wall, and the terminal 311 has a terminal protrusion 311*a*' protruding a front side of the terminal, so that the terminal is contacted with the electrode plate so as to push the electrode plate toward the cartridge to receive an electrical signal from the electrode plate.

The electrode plate 321 is mounted in front of a rear wall opening to contact with the terminal of which the terminal protrusion protruded there through.

The electrode plate 321 is contacted to detergent contained in the cartridge via a cartridge electrode plate opening 216*a*, 216*b*, 216*c*.

Electrode plate 321 allows electric current to flow the electrode plate 321 in a state that the electrode plate 321 is contacted to detergent, so the electric current is transmitted the controller 3 through the terminal disposed at a rear side thereof.

Hereinafter, referring to FIG. 5 through FIG. 8 and FIG. 11, structure and operation of a check valve assembly 400 will be described.

Check valves 400*a*, 400*b*, 400*c*, 400*d*, 400*e*, 400*f* (hereinafter referred to as "400") according to an exemplary embodiment of the present disclosure may include a first check valve housing 410, a first check valve 420 installed at the first check valve housing 410, a check valve cap 430 for preventing detergent and air from leaking through the first check valve 420, a docking pipe 440 capable of moving detergent of the cartridge 200 toward the check valve in a state of being connected to the docking valve 250 of the cartridge 200, a docking pipe circumference 450, a second check valve housing 460, a second check valve 470 installed at the second check valve housings 460, and an outlet passage connecting pipe 480 connected to the outlet passage 800 in state of being connected to the second check valve housing 460.

Check valve o-rings 411 may be snugly inserted between the first check valve housing 410 and the second check valve housing 460 so as to connect the first check valve housing 410*a* to the second check valve housing 460 and function to provide airtight.

The first check valve 420 and the second check valve 470 according to an exemplary embodiment of the present disclosure may be formed as a rubber. As a result of the foregoing, there is no need to employ a spring as conventional manner, because it is possible to block one-way flow of fluid by using an elastic force of a rubber, so it is possible to minimize a space of the housing, and further arrange various parts therein without any space loss.

The first check valve 420 and the second check valve 470 are disposed along an opposite direction to a direction of the cartridge 200. Thus, the first check valve 420 is capable of being opened only in a direction toward a second space S2, and the second check valve 470 is capable of being opened only in a direction toward a third space S3.

Detergent inlets 441 allowing detergent supplied from the cartridge 200 to inject to the docking valve are disposed at the docking pipe 440. A first docking pipe o-ring 442 and a second docking pipe o-ring 442 are snugly inserted to a first docking pipe o-ring groove 442 and a second docking pipe o-ring groove 443 so as to prevent detergent from leaking to the outside while detergent is injected to the detergent inlet.

Docking pipe springs are installed at the docking pipe circumference 450. The docking pipe spring 451 is capable of connecting fixedly the check valve assembly 400 to the docking valve 250 through an elastic force of the docking pipe spring, and further easily disassembling the cartridge 200 from the housing 110 through the elastic force of the docking pipe spring.

An inlet passage connector 461 connected to the inlet passage 700 and an outlet passage connector 463 connected to the outlet passage 800 are installed at the second check valve housing 460. The inlet passage connector 461 is snugly connected to the inlet passage 700 through the inlet passage connector covers 462.

The outlet passage connecting pipe 480 is fixedly connected to an end of the outlet passage connector 463*a* by outlet passage connecting o-rings 482. The outlet passage connecting pipe 480 is snugly connected to the outlet passage 800 by outlet passage connecting covers 481.

Negative pressure or positive pressure generated by reciprocating movement of a piston body 580 disposed at the pump 500 is guided to the second space S2 of the check valve assembly 400*a* through the inlet passage 700.

According to an exemplary embodiment of the present disclosure, a negative pressure generated by reverse movement of the piston body 580 is guided to the second space S2 through the inlet passage 700. Thus, the first check valve 420*a* is opened by the negative pressure in the second space S2. At this time, detergent of the cartridge 200*a* is guided to the second space S2 by the negative pressure in the second space S2 via the first space S1 of the docking pipe 440 and the first check valve 420.

When the detergent is guided to the second space S2, the piston body 580 moves forward and then a positive pressure generated by the movement as above is again guided to the second space S2 through the inlet passage 700. At this time, the second check valve 470*a* is opened by a positive pressure in the second space S2, and the first check valve 420 is kept closed. Therefore, detergent in the second space S2 is transferred to the third space S3 of the second check valve housing 460 by a positive pressure in the second space S2. Detergent transferred to the third space S3 is discharged to the outlet passage 800 by positive pressure in the second space S2 and the third space S3 so as to be provided to the tub 31 or drawer 39 etc., with water supplied.

Hereinafter, referring to FIG. 5 through FIG. 8 and FIG. 13, a structure and an operation of the pump 500 will be described.

A pump 500 according to an exemplary embodiment of the present disclosure includes a housing 510 accommodating pump parts, a motor 520 generating power, a first gear 530 rotated by the motor 520, a second gear 540 rotating in a state of being engaged with the first gear 530, a third gear 550 rotating in a state of being engaged with the second gear 540, a crank gear rotating in a state of being engaged with the third gear 550, a connecting rod 570 connecting the crank gear 560 to the piston, a piston 580 transferring positive pressure or negative pressure to the passage switching valve 600 using by reciprocating movement, and a cylinder 590 defining a room for a space of the piston's reciprocating space.

The first gear 530 is engaged with the motor so as to be integrally rotated with the motor 520. The first gear 530 may be a helical gear. A helical gear has an advantage of reducing a noise generated in the motor 520 and transferring power easily. The second gear may be a worm gear. Since the pump 500 is installed between the inlet passage 700, the outlet passage 800 and the passage switching valve 600 etc., there is a need to assemble with high density for space efficiency. Therefore, according to an exemplary embodiment of the present disclosure, the motor 520 may be installed horizontally, and the second gear 540 may function as a worm gear so as to switch a direction of rotating power and transferring thereto.

The second gear 540 and the third gear 550 are integrally rotated. The crank gear 560 is rotated in a state of being engaged with the third gear 550. The crank gear 560 may have more greater number of teeth than that of the third gear 550 so as to transfer strong power thereto during reciprocating movement of the piston 580.

The crank gear 560 includes a crank shaft 561 functioning as a rotating axis of the crank gear, a crank arm 562 extended from the crank shaft, and a crank pin 563 connected to the connecting rod 570. The crank pin 563 and the connecting rod 570 are rotatably connected to each other so that the connecting rod 570 is capable of linearly moving along a direction of the cylinder 590 according to rotation of the crank pin 563 during rotation of the crank gear 560.

The connecting rod 570 is connected to the piston 580, and the piston 580 is snugly inserted to the cylinder 590 so as to move reciprocatively along a longitudinal direction of the cylinder 590. At this time, positive pressure or negative pressure may be transferred to the passage switching valve 600 connected to the cylinder 590 through a linear movement of the piston 580. When the piston 580 is moved toward the passage switching valve 600, positive pressure is transferred to the passage switching valve 600, and on the other hand, when the piston 580 is moved along the opposite direction of the passage switching valve 600, negative pressure is transferred to the passage switching valve 600.

Hereinafter, referring to FIG. 5 through FIG. 8 and FIG. 12 through FIG. 13, a structure of a passage switching valve 600 will be described.

A passage switching valve 600 according to an exemplary embodiment of the present disclosure includes an upper housing 610 connected to the cylinder 590 of the pump 500, a lower housing 650 connected to the upper housing 610, a disc 620 rotatably disposed in the housing 610, a spring valve 630 disposed at the disc 620, a shaft 640 rotating the disc 620, a micro switch 660 disposed at a lower side of the lower housing 650 and a passage switching motor 670 rotating the shaft 640.

A passage connecting opening 651 connected to an inlet passage 700 are disposed at the lower housing 650 so that fluid that has passed through a disc hole 621 of the disc 620 may pass through the passage connecting opening 651. And then the fluid is supplied to each inlet passage 700 connected thereto via each passage outlet openings.

The spring valve 630 is installed at the disc hole 621 of the disc 620. The spring valve 630 includes a spring 631 providing an elastic force, a spring shaft 632 preventing the spring 631 from being separated, and a cover unit 633 covering the passage connecting opening 651*a* with an elastic force of the spring 631.

Hereinafter, referring to FIG. 5 through FIG. 8 and FIG. 12 through FIG. 13, an operation of a passage switching valve 600 will be described in detail.

When detergent is selected for being supplied, the passage switching motor 670 is operated by electric power supplied. The operated passage switching motor 670 functions to rotate the shaft 640 connected thereto and also the disc 620 connected to the shaft 640.

At this time, the spring valve 630 installed at the disc 620 is also integrally rotated corresponding to a rotation of the disc 620, and when the passage connecting opening 651 of the lower housing 650 is positioned at a rotary position of the spring valve 630, the cover unit 633 functions to block the passage connecting opening 651 by using an elastic force of the spring 631.

The controller 3 may control a rotary angle of the disc 620 so as to prevent the spring valve 630 from positioning at the passage connecting opening 651 connected to the check valve assembly 400, and so as to connect the check valve assembly 400*a* connected with cartridge accommodating detergent for supply to with the pump 500.

When the spring valve 630 is not placed at the passage connecting opening 651, the pump 500 and the passage connecting opening 651 are opened and positive or negative pressure generated in the pump 500 is sequentially transferred to the inlet passage 700 and the check valve assembly 400 through the passage connecting opening 651 so as to supply detergent of the cartridge 200 to the outlet passage 800.

While the controller 3 controls a rotary angle of the disc 620, the spring valve 630 is placed at the passage connecting opening 651 connected to the check valve assembly 400 and the cover unit 633 functions to block the passage connecting opening 651*a* with an elastic force of the spring 631 so as to cut off the flow between the check valve assembly 400 connected to cartridge having no need to be supplied and the pump 500.

When the spring valve 630 is placed at the passage connecting opening 651, the flow of the pump 500 through the passage connecting opening 651 is cut off, and positive pressure or negative pressure generated in the pump 500 is not moved to the check valve assembly 400, so detergent in the cartridge 200 is not moved.

It is required to detect a rotary angle of the disc 620 with the micro switch 660 to put the disc 620 on a desired rotary angle so as to precisely control the rotary angle of the disc 620.

While the spring valve 630 of the disc 620 is not placed on a position of the passage connecting opening 651, the spring valve 630 is placed on an upper surface 652 of the lower housing 650. And when the spring valve 630 is placed on a position of the passage connecting opening 651 by rotation of the disc 620, the spring valve 630 is extended so as to block the passage connecting opening 651.

A plurality of passage connecting openings 651 is capable of being opened so that a plurality of detergent is supplied. And, a plurality of spring valves 630 may be provided so as to block the plurality of passage connecting openings 651.

Hereinafter, referring to FIG. 5 through FIG. 8, an inlet passage 700 and an outlet passage 800 will be described in detail.

According to an exemplary embodiment of the present disclosure, the inlet passage 700 is connected to the inlet passage connector 461 of the check valve assembly 400, and further the inlet passage 700 is connected to the passage outlet openings 653 of the passage switching valve 600 so as to transfer fluid transferred by the pump 500 to the check valve assembly 400.

A plurality of inlet passages 700 are respectively connected to each of a plurality of inlet passage connectors 461 and each of a plurality of passage outlet openings 653.

According to an exemplary embodiment of the present disclosure, there may be the passage switching valve 600 disposed at a center thereof, three cartridges 200 disposed at both sides thereof and a check valve assembly 400 connected to the three cartridge 200.

The inlet passages 700*a*, 700*b*, 700*c* disposed at the left side thereof is respectively connected to the inlet passage connector 461 of the left check valve assemblies 400*a*, 400*b*, 400*c* and the passage outlet openings 653 disposed adjacently at a left side of the passage switching valve 600.

The inlet passages 700*d*, 700*e*, 700*f* disposed at the right side thereof is respectively connected to the inlet passage connector 461 of the right check valve assemblies 400*d*, 400*e*, 400*f* and the passage outlet openings 653 disposed adjacently at a left side of the passage switching valve 600.

The inlet passages 700*a*, 700*b*, 700*c* disposed at a left side thereof through a first inlet passage plate 710 and the inlet passages 700*d*, 700*e*, 700*f* disposed at a right side thereof through a second inlet passage plate 720 are integrally disposed so as to fix the inlet passages, and fluid is stably supplied.

According to an exemplary embodiment of the present disclosure, an outlet passage 800 is connected to an outlet passage connecting pipe 480 of the check valve assembly 400, and the outlet passage 800 functions to supply detergent supplied from the outlet passage connecting pipe 481 to the tub 31 or the drawer 39 through a provider 820.

A water supply valve 830 is disposed at an end of the outlet passage 800 so as to supply water supplied from the outdoor water source to the outlet passage 800, and then water supplied from the water supply valve 830 is transferred to the outlet passage 800 via a water supply hose 840.

After water is supplied through check valve connectors 850*a*, 850*b*, 850*c*, 850*d*, 850*e*, 850*f* connected to the outlet passage connecting pipe 481*a* of the check valve assembly 400, the water is discharged to the provider 820 with detergent supplied to the outlet passage 800 while the water is moved toward the provider 820 disposed at the other end of the outlet passage 800.

The check valve connector 850 is connected to a lateral surface of the outlet passage 800. Each of the check valve connector 850 is connected to each of the outlet passage connector 480, so detergent discharged from the outlet passage connector 480 is transferred to the outlet passage 800 through the check valve connector 850.

According to an exemplary embodiment of the present disclosure, the outlet passage 800 is installed such as being divided into a left outlet passage 800*a* and a right outlet passage 800*b* with respect to the passage switching valve 600, and a connecting hose 810 is installed between the left outlet passage 800*a* and the right outlet passage 800*b* so as to connect the left outlet passage 800*a* with the right outlet passage 800*b*. Herein, the connecting hose 810 takes the form of channel-shape so as to make a space for installing the passage switching valve 600, and further to prevent the outlet passage 800 from intervening the passage switching valve 600.

Figure 15:
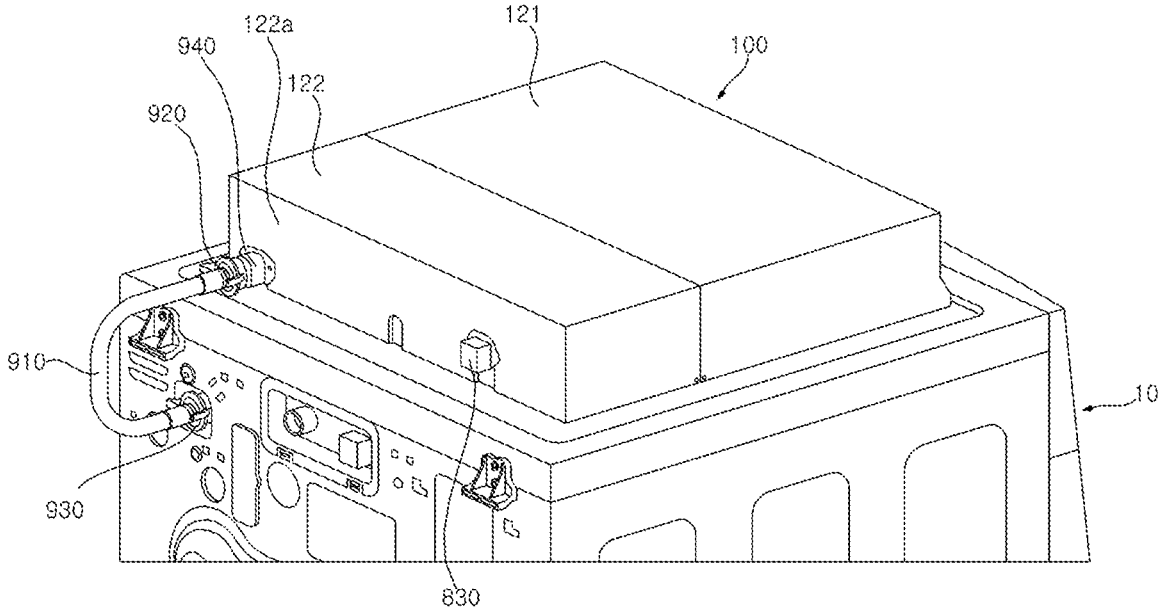
FIG. 15 is a schematic view showing positions of a first electrode plate, a second electrode plate and a third electrode plate of a rear side of a cartridge according to an exemplary embodiment of the present disclosure.
Figure 16:
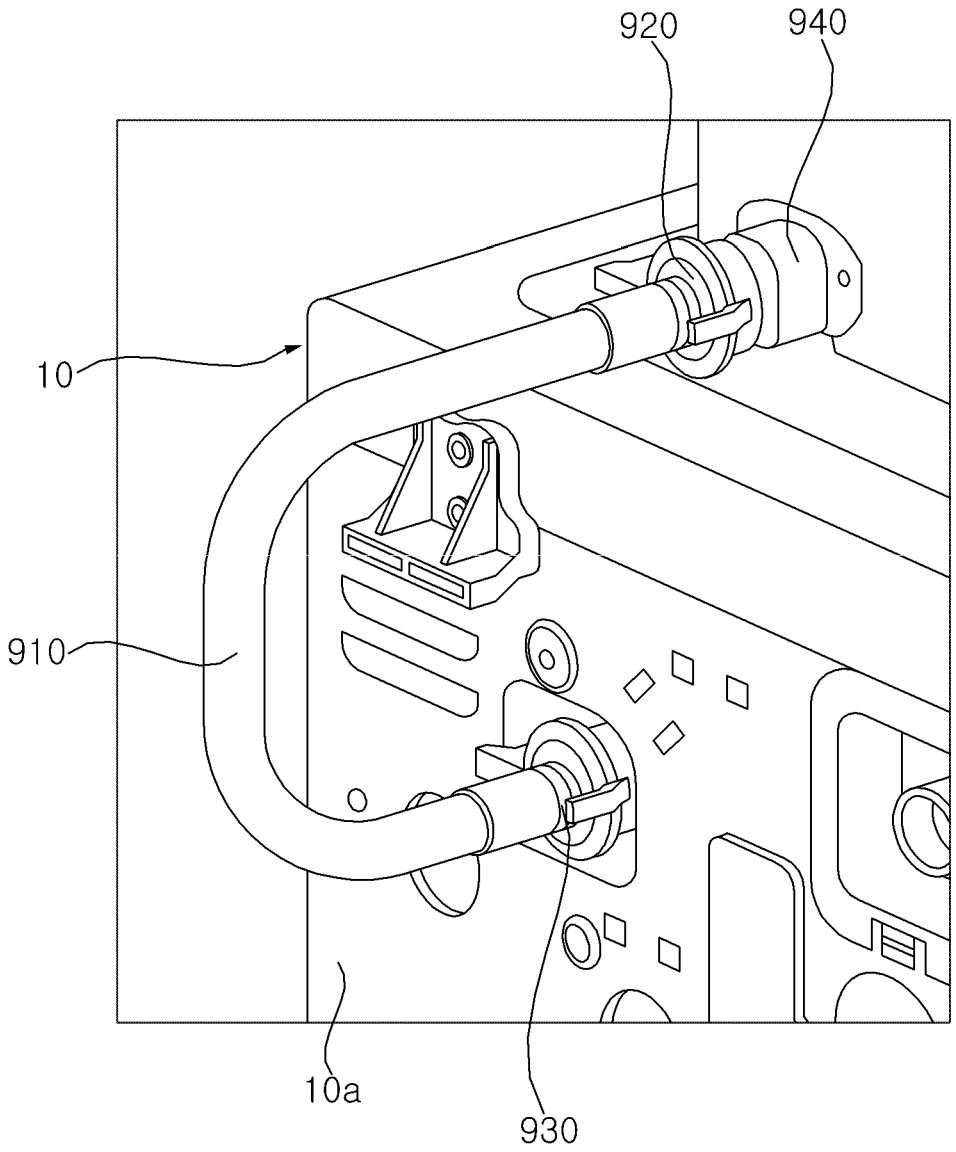
FIG. 16 is a schematic view showing a passage connector.
Figure 17:
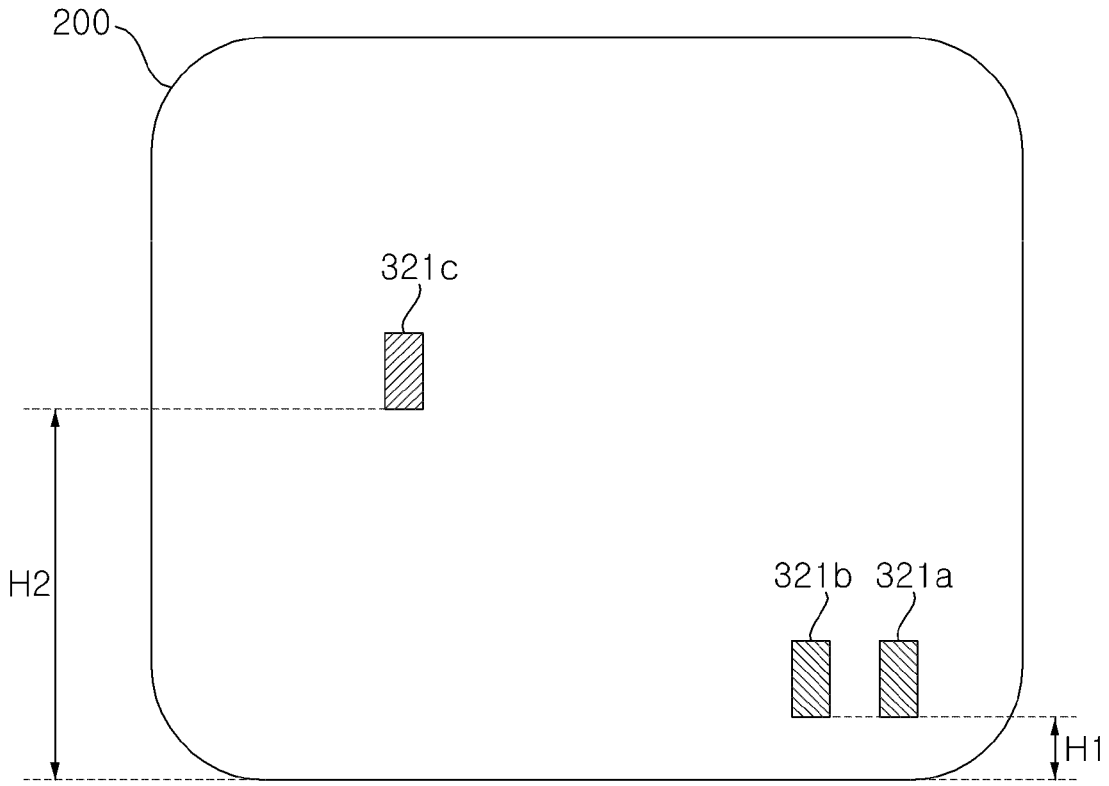
FIG. 17 is an enlarged view showing the passage connector shown in FIG. 16.

Hereinafter, referring to FIG. 15 and FIG. 16, a passage connector 900 according to an exemplary embodiment of the present disclosure will be described in detail.

A passage connector 900 includes a connecting hose 910 connecting the cabinet 10 with the detergent supply device 100, a first head 920 installed at an end of the connecting hose 910 in which the first head 920 is connected to the detergent supply device 100, a second head 930 installed at the other end of the connecting hose 910 in which the second head 930 is connected to the cabinet 10, a first connector 940 connecting the first head with the detergent supply device 100, a second connector 950 connecting the second head 930 with the cabinet 10, a connecting body 960 disposed so as to encompass the connecting hose 910, and a body opening 970 disposed at a center of the connecting body 960.

The passage connector 900 functions to transfer detergent supplied from the outlet passage 800 of the detergent supply device 100 to drawer 39 in the cabinet 10 or tub 31.

A cover 120 of the detergent supply device 100 includes a first cover 121 covering a front side of the cartridge 200 and a second cover 122 covering a rear side of main parts except for the cartridge. The first cover 121 and the second cover 122 may encompass all the surface of the detergent supply device 100.

The first connector 940 is installed at a rear surface of the second cover 122. The first connector 940 includes a head connector 941 connected to the first head 920, a head mount 942 mounted to the first head 920, a supporter 943 fixing the first connector 940 to a rear surface of the second cover and a supply connector 944 connecting the first connector 940 with the outlet passage 800.

The head connector 941 is inserted inside a space in which the first head 920 defines, so that detergent and water discharged from the head connector 941 are transferred to the connecting hose 910 through the first head 920.

A ball 921 is installed at an inner circumference of the first head 920, and the first head 920 is mounted at the head connector 942 of the first connector 940 when the first head 920 is inserted to the first connector 940. Thus, the ball 922 and the head connector 942 are fixedly connected to each other so that the first head 920 and the first connector 940 are not separated from each other while fluid is discharged to the connecting hose 910.

The supporter 943 takes the form of plate in which the supporter 943 is disposed perpendicular to a longitudinal direction of the first head 920 at a center of the first head 920. The plate-shaped supporter 943 is contactly mounted at a rear surface of the second cover 122. The supporter 943 functions to secure the first connector 940 so as to prevent the first connector 940 from being swayed by oil pressure. According to an exemplary embodiment of the present disclosure, a hole is be formed at the supporter 943 so that the supporter 943 can be bolted to a rear surface of the cover, but is not limited thereto.

The supply connector 944 is connected to the supplying pipe of the outlet passage 800 so that water blended with detergent in which the water discharged from the outlet passage 800 is transferred to the connecting hose 910.

The second connector 950 is installed at a rear surface 10*a* of the cabinet 10. The second connector 950 includes a head connector 951 insertly connected to the second head 930, a head connector 952 connected to the second head 930, a supporter 953 securing the second connector 950 to a rear surface 10*a* of the cabinet and an inlet connector 944 connecting the second connector 950 with the tub 31 or the drawer 39.

The head connector 951 is inserted to inside of a space where the second head 930 is penetrating, and then the head connector 951 transfer detergent and water supplied from the connecting hose 910 and the second head 930 to the tub 31 of the cabinet or the drawer 39.

A ball 931 is installed at an inner circumference of the second head 930 in which the ball is mounted to the head connector 952 of the second connector 950, when the second head 930 is inserted to the second connector 950. Thus, the ball 931 and the head connector 952 are fixedly connected to each other so as to prevent the second head and the second connector from being separated from each other by oil pressure while fluid is discharged to the tub 31 of cabinet or the drawer 39.

The supporter 953 takes the form of plate in which the supporter 953 is disposed perpendicular to a longitudinal direction of the first head 930 at a center of the second head 930. The plate-shaped supporter 953 is contactly mounted to a rear surface 10*a* of the cabinet so as to prevent the second connector 950 from being swayed by oil pressure. According to an exemplary embodiment of the present disclosure, a hook is disposed at the supporter 953 so as to be connected to a rear side of the cabinet, but is not limited thereto.

The inlet connector 954 may be connected to the tub 31 or drawer 39. In a case that the inlet connector 954 is connected to the tub 31, detergent had passed through the inlet connector 954 may be directly transferred to the tub 31. Meanwhile, in a case that the inlet connector 954 is connected to the drawer 39, detergent had passed through the inlet connector 954 may be transferred to the tub 31 through the drawer 39.

The first head 920 and the second head 930 are disposed respectively detachably to the first connector 940 and the second connector 950. Thus, when the detergent supply device 100 is not in use, the first head 920 and the second head 930 are separated from the first connector 940 and the second connector 950, and then the passage connector 900 is separated from the cabinet 10 and the detergent supply device 100. In other hands, when the detergent supply device 100 is in use, the first head 920 and the second head 930 are connected to the first connector 940 and the second connector 950, and then the passage connector 900 is connected to the cabinet 10 and the detergent supply device 100, so detergent of the detergent supply device 100 is capable of being transferred to the tub 31 in the cabinet 10.

The first connector 940 is installed at a rear surface 122*a* of the second cover 122 and the second connector 950 is installed at a rear surface 10*a* of the cabinet 10, and further the passage connector 900 is installed at a rear side of the cabinet 10. That is, the passage connector 900 is installed at an invisible position to a user, so it is possible to provide natural appearance between the passage connector 900 and the other parts.

Referring to the attached drawings according to the other exemplary embodiment of the present disclosure, there may be further included a connecting body 960 disposed so as to encompass the connecting hose 910. The connecting body 960 is made of hard material, while the connecting hose 910 is made of soft material. Therefore, a user can easily assemble or disassemble the passage connector 900 with grabbing a body opening 970 of the connecting body 960 when a user has the intend of assembling or disassembling the passage connector 900.

To supply detergent accommodated in the cabinet to a main washing machine through the detergent supply device, it is required to determine if the main washing machine is connected with the detergent supply device, and in doing so, after information about a laundry that was identified in the main washing machine is transmitted to the detergent supply device, appropriate detergent is supplied to the laundry.

Hereinafter, referring to FIG. 14 and FIG. 15, the number and the height of electrode sensor installed at a rear surface of a cartridge according to an exemplary embodiment of the present disclosure will be described in detail.

According to an exemplary embodiment of the present disclosure, three terminals and three electrode plates are provided per one cartridge. The first terminal 311*a*, the first electrode plate 321*a*, the second terminal 311*b* and the second electrode plate 321*b* are disposed at a lower side of the cartridge and a side of the docking valve 250.

The third terminal 311*c* and the third electrode plate 321*c* are disposed at an upper side of the cartridge and the other side of the docking valve 250.

The first electrode plate 321*a* and the second electrode plate 321*b* have a first height H1 at a rear surface of the cartridge. The third electrode plate 321*c* has a second height H2 which is higher than the first height H1 at a rear surface of the cartridge. Cartridge electrode plate openings 216*a*, 216*b*, 216*c* are disposed at a rear surface of the cartridge corresponding to a position where the first, second and third electrode plates 321*a*, 321*b*, 321*c* are installed. Thus, the first, second and third electrode plates 321*a*, 321*b*, 321*c* are connected to the inside of the cartridge although the opening 216*a*, 216*b*, 216*c* so that an electric current and/or a voltage is generated since the first, second and third electrode plates 321*a*, 321*b*, 321*c* are contacted with detergent in the cartridge.

According to an exemplary embodiment of the present disclosure, the first and second electrode plates 321*a*, 321*b* are formed as respectively a separate electrode in which the first and second electrode plates 321*a*, 321*b* are disposed at a lower side of the cartridge 200*a*, and the third electrode plate 321*c* is installed at an upper side of the cartridge 200*a*. Each electrode sensor comprises one electrode plate and one terminal. The first two electrode sensors comprise a first electrode sensor. A second two electrode sensors comprises one of the first and second electrode sensor and a third electrode sensor. Herein, a first sensor value is obtained by the first two electrode sensors in a case that the first electrode plate and the second electrode plate are electrified. And, a second sensor value is obtained in a case that the first electrode plate or the second electrode plate are electrified with the third electrode plate. Therefore, it is possible to detect residual quantity of detergent in the cartridge by comparing the first sensor value with the second sensor value, and to detect malfunction of the electrode sensor and further it is possible to determine electrodes are appropriately installed or not.

The electrical sensor 300 outputs a signal when a positive electrode and a negative electrode are electrified through a medium in which the positive electrode and the negative electrode are disposed adjacently to each other. Thus, when there is enough detergent in the cartridge, the detergent functions as a medium for electrifying the electrode sensor 300, and a result for the foregoing the terminal detects a residual amount of detergent in the cartridge.

According to an exemplary embodiment of the present disclosure, the first and second electrodes 321*a*, 321*b* take the form of "L" rather than rectangular. That is, if the two electrodes are positioned adjacently to each other, the two electrodes are electrified and wrong signal can be detected by an interference between the two electrodes. A width of a lower side of the electrode plate which detergent is contacted can be made thinly so as to reduce the interference between the first and second electrodes. At this time, an appearance of the electrode plate is not limited to L-shape as long as an interference is minimized.

Figure 19A:
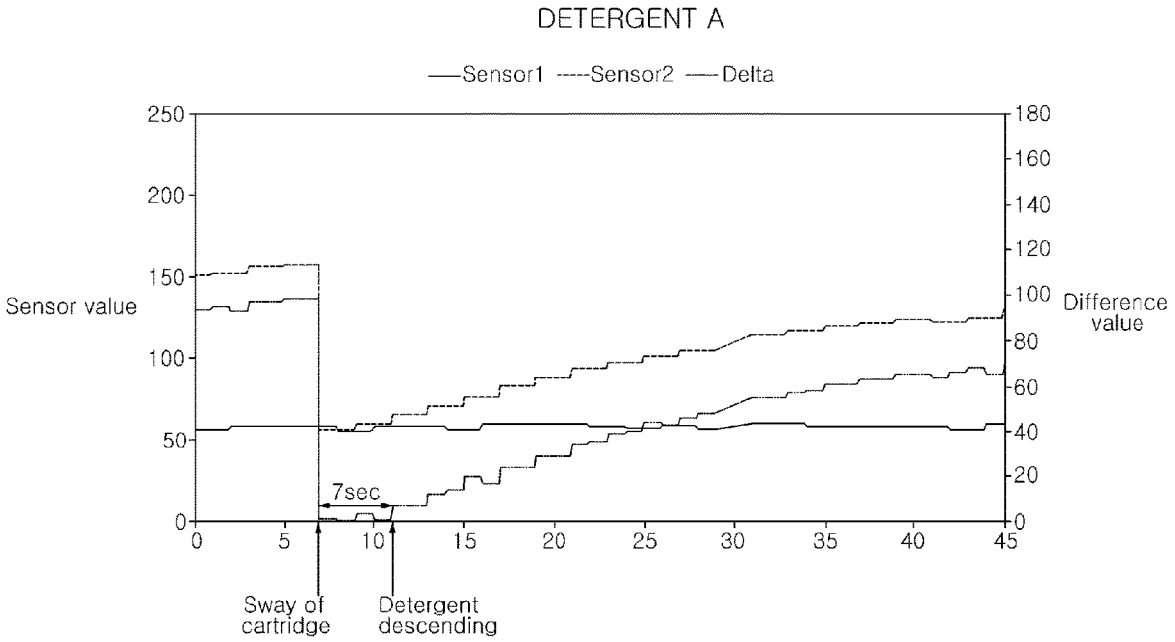
FIGS. 19A and 19B are graphs indicating a first sensor value and a second sensor value, and the difference value therebetween according to a time of A and B in a case that a cartridge is swayed.
Figure 19B:
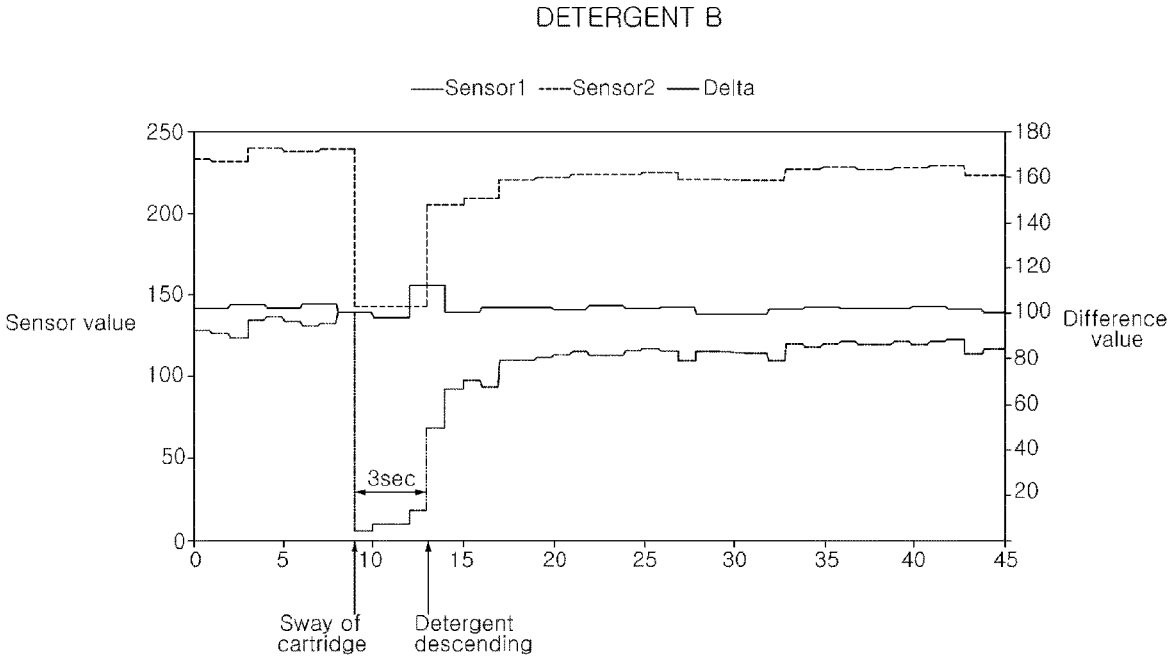
Figure 20:
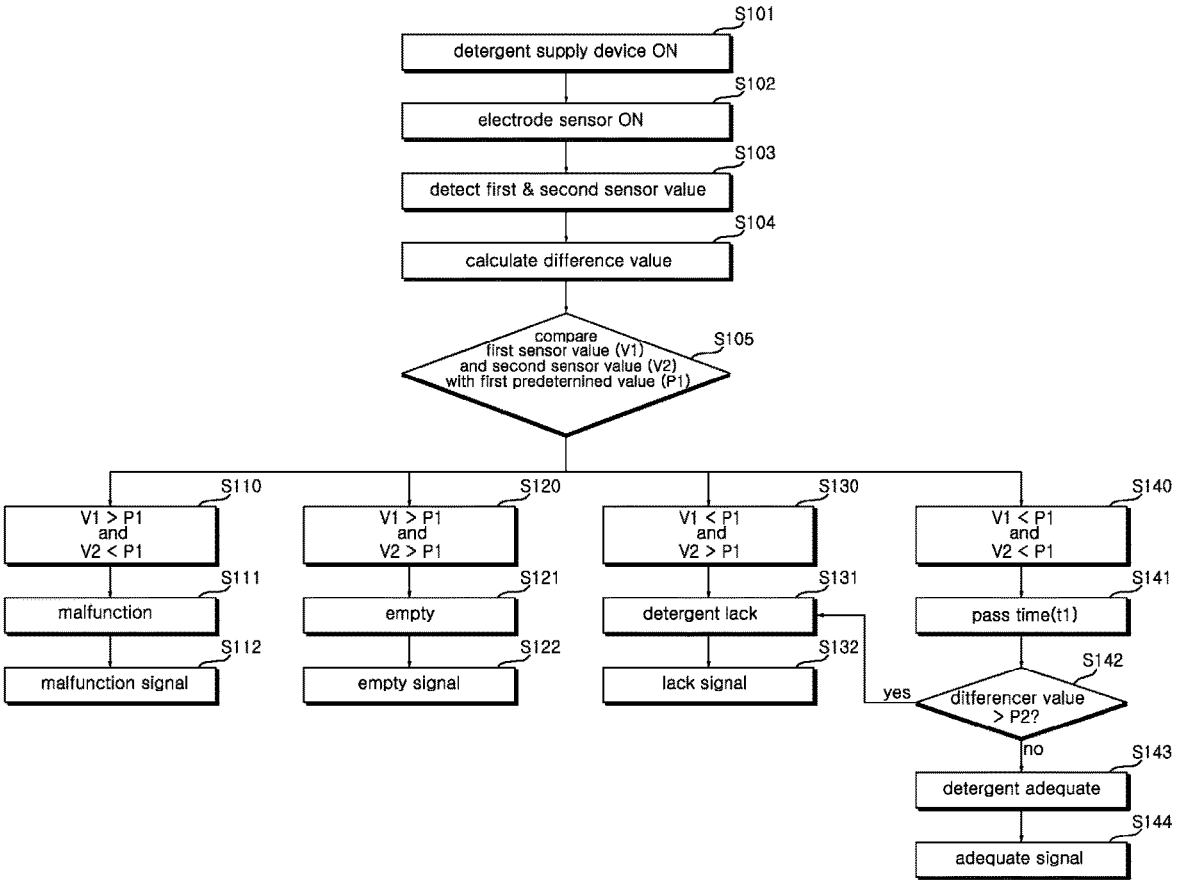
FIG. 20 is a flow chart indicating a detection algorithm detecting detergent quantity.

Hereinafter, referring to FIG. 18 through FIG. 20, algorithm detecting an amount of detergent will be described in detail.

When detergent is contacted to the electrode plate 321 of the electrode sensor, it can be electrified, and so it is possible to detect a residual quantity of detergent. Conventional electrode sensor detects a residual quantity of detergent with a pair of electrode sensors adjacently disposed at the same height each other. Like said above, in a case that the first two electrode sensors are installed per a cartridge, the first two electrode sensors can be electrified because the cartridge is swayed, or the first two electrode sensors are electrified due to detergent hardened at a surface of the two electrodes even though detergent is not enough in the cartridge. Therefore, there may be a problem of detecting hardly a residual quantity of detergent precisely.

According to an exemplary embodiment of the present disclosure, at least three electrode sensors are installed at a rear surface of a cartridge, and among at least three electrode sensors the first sensor value is obtained by the first two electrode sensors. And, the second sensor value is obtained by the second two electrode sensors having a higher position compared to at least one of electrode sensor of the first two electrode sensors. And then, it is possible to determine a residual quantity of detergent by the first sensor value and the second sensor value. Furthermore, it is possible to increase an accuracy of detecting a residual quantity of detergent, and to determine malfunction or unmount of the electrode sensor.

In addition, in such a case that a plurality of electrode sensors are provided, it is possible to detect a residual quantity of detergent according to each height of the plurality of electrode sensors. And, it is possible to detect a residual quantity of detergent classified densely.

One of the first two electrode sensors is formed as a receiver, and the other is formed as a transmitter. It is the same manner in case of the second two electrode sensors. The second two electrode sensors may include one of the two electrode sensors. At this time, the first two electrode sensors are respectively formed as a receiver and a transmitter, and an electrode sensor excluded in the first two electrode sensors of the second two electrode sensors is formed as a receiver which is capable of receiving a current through one of the first two electrode sensors.

A difference between the first sensor value and the second sensor value is obtained after the first sensor value and the second sensor value are detected by the first two electrode sensors and the second two electrode sensors. And then, the first sensor value and the second sensor value are compared with a first predetermined value.

The sensor value described below is a value which a voltage generated detected by the electrode sensors is converted into. Specifically, the value may be a converter value in which a range between 0 v and 5 v is divided by eight bit. It can be identified in the graph of FIG. 19A and FIG. 19B, in doing so, it is possible to detect whether it is electrified. Referring to FIG. 19A and FIG. 19B, the value of 255 in Y-axis of the graph means there is not electrified, and it means the closer it goes to zero, the stronger the electricity flows.

A first predetermined value as described below means a limit value generated when the cartridge is almost empty. According to an exemplary embodiment of the present disclosure, it is possible to define the first predetermined value as a value which a converter value is 200, but is not limited thereto. Thus, it can be determined based on the other detected value according to a type of detergent, a position of a cartridge and a movement thereof.

A second predetermined value as described below means a value in which the difference between the first sensor value and the second sensor value is within an error range. In other words, if it is determined that there is detergent in a cartridge when the first sensor value and the second sensor value are detected, the second predetermined value may be a reference value in a case that the difference between the two values is within an error range.

According to an exemplary embodiment of the present disclosure, the second predetermined value is set to 10, but is not limited thereto. Thus, it can be determined based on a detected value according to a type of detergent, a position of a cartridge and a movement thereof.

A step for comparing a first sensor value with a second sensor value is performed, and when the first sensor value and the second sensor value are less than the first predetermined value, a step for passing time during a predetermined time is performed. After the step for passing time, a step comparing the obtained difference with the second predetermined value is performed.

That is, when there is enough amount of detergent, each of the first sensor value and the second sensor value is less than the first predetermined value so that it is determined that there is enough detergent in a cartridge, but there is a chance to misjudge that there would be enough detergent in the cartridge in a case that detergent is contacted to an electrode sensor disposed at an upper side of a cartridge due to sway of the electrode sensor or another reasons.

After the predetermined time is passed, because detergent stained on an upper electrode sensor runs down to a lower side thereof, and a converter value detected is increased as much as a value of empty cartridge. In doing so, it is possible to determine whether if there is enough detergent in a cartridge or whether it was merely misjudged that there would be enough detergent in a cartridge due to detergent contacted on the upper electrode sensor.

After the predetermined time is passed, a step for comparing the difference value between the first sensor value and the second sensor value with the second predetermined value is performed. When the difference is greater than the second predetermined value, it is determined that detergent is filling to a height between the first two electrode sensors and the second two electrode sensors in which the second two electrode sensors have at least one electrode sensor positioned higher than the first two electrode sensors.

Because the second predetermined value is set to an error reference value, when the error reference value is greater than the second predetermined value, it is assumed that the voltage difference between the first two electrode sensors is increased, and which is corresponded to misjudgment of detergent. Therefore, a detergent is not filling at a height as much as the upper electrode sensor, while high voltage is flowing through a lower electrode sensor, and so it is possible to determine that detergent is filling as much as a height between the upper electrode sensor and the lower electrode sensor.

Referring to FIG. 19A and FIG. 19B, there is not enough detergent at the beginning comparably, so the first sensor value and the second sensor value is positioned on higher position comparably. Meanwhile, when it is occurred by according to a misjudgment of an electrode sensor due to sway of the electrode sensor or due to detergent hardened on the electrode sensor, the first sensor value and the second sensor value are rapidly decreased.

After that, detergent on an electrode sensor or detergent hardened on an electrode sensor runs down to a lower side thereof, so the second sensor value detected by the electrode sensor disposed at an upper side thereof is slightly increased. Because detergent having a high viscosity of FIG. 19A needs much time to run down, a graph according to a detergent decrease is gentle. The time to reach the second predetermined value of 10 is about 7 seconds, and it is longer than that of FIG. 19B in which the second predetermined value is related with a difference according to an exemplary embodiment of the present disclosure.

Meanwhile, because detergent having a low viscosity of FIG. 19B needs shorter time to run down, a graph according to a detergent decrease is rapid. The time to reach the second predetermined value of 10 is about 3 seconds, and it is shorter than that of FIG. 19A in which the second predetermined value of 10 is related with a difference according to an exemplary embodiment of the present disclosure.

After passing the predetermined time, comparing the difference value between detected first and second sensor values with the second predetermined value, when the difference value is less than the second predetermined value, it is determined that detergent is filling higher than a height of the second two electrode sensors.

At the step for comparing the first sensor value with the second sensor value and the first predetermined value, when the first sensor value is greater than the first predetermined value and the second sensor value is less than the first predetermined value, it is determined to malfunction or bad connection of the electrode sensors. That is in a case that it cannot be occurred in case of being normally operating with gravity. The display 6 may output a signal indicating a malfunction or bad connection so that a user can easily recognize it.

At the step for comparing the first sensor value and the second sensor value with the first predetermined value, when each of the first sensor value and the second sensor value is greater than the first predetermined value, it is determined that detergent is filling lower than a height of first two electrode sensors in which the first two electrode sensors are positioned comparably at a lower height than that of the second two electrode sensors. This is because in a case that the electrode sensors are not electrified by detergent. When an electrode sensor disposed at a lower side thereof is adjacent to the floor, it is possible to determine that a cartridge is empty or unmounted. The display 6 may output a signal indicating that a cartridge is empty or unmounted so that a user can easily recognize it.

At the step for comparing the first sensor value and the second sensor value with the first predetermined value, when the first sensor value is less than the first predetermined value and the second sensor value is greater than the first predetermined value, it is determined that detergent is filling as much as a height between the first two electrode sensors and the second two electrode sensors. This is because detergent can be detected only by a lower electrode sensor. When a height between the first two electrode sensors and the second two electrode sensors is low comparably, it is determined to the lack of detergent. The display 6 may output a signal indicating the lack of detergent so that a user can easily recognize it.

Hereinafter, referring to FIG. 20, detecting residual quantity of detergent in the cartridge in which there is provided with the three electrode sensors according to an exemplary embodiment of the present disclosure will be described.

According to an exemplary embodiment of the present disclosure, the three electrode sensors are installed at least one of the cartridges, the three electrode sensors include the first and the second electrode sensors 301*a*, 301*b* having the first height H1 and the third electrode sensor 301*c* having the second height H2.

After the detergent supply device 100 is turned on (S101) and electrode sensors are turned on (S102), the first sensor value is detected by the first and second electrode sensors 301*a*, 301*b*, a second sensor value is detected by the first and third electrode sensors 301*a*, 301*c*, or the second and third electrode sensors 301*b* and 301*c* (S103) and the difference value between the second sensor value and the first sensor value is calculated (S104), Instead, the above step S104 can be performed after a following step S141 is performed.

After that, step for comparing the first sensor value and the second sensor value with the first predetermined value is performed (S105).

When the first sensor value is greater than the first predetermined value and the second sensor value is less than the first predetermined value (S110), it is determined that the electrode sensors are malfunction or bad connection (S111). The display 6 outputs a signal (S112) indicating malfunction or bad connection so that a user can easily recognize it.

When each of the first sensor value and the second sensor value is greater than the first predetermined value (S120), it is determined (S121) that detergent is filling at a lower height than a height H1 of first and second electrode sensors 301*a*, 301*b*. When H1 is severely low, it is possible to determine (S121) that a cartridge is empty or unmounted. The display 6 may output (S122) a signal indicating that a cartridge is empty or unmounted so that a user can easily recognize it.

When the first sensor value is less than the first predetermined value and the second sensor value is greater than the first predetermined value (S130), it is determined that detergent is filling as much as a height between a first and a second electrode sensors 301*a*, 301*b* and third electrode sensor 301*c* (S131). When a height (H2–H1) between the first and second electrode sensors 301*a*, 301*b* and the third electrode sensor 301*c* is low, it is determined to the lack of detergent (S131). The display 6 may output a signal indicating the lack of detergent so that a user can easily recognize it.

When each of the first sensor value and the second sensor value are less than the first predetermined value (S140), the time needed for detergent to be descended is passed (S141). After the time t is passed, the first and second sensor values redetected, and a difference value between the redetected first sensor value and second sensor value is calculated and then compare the difference value with the second predetermined value (S142). When the difference value is greater than the second predetermined value, it is determined to the lack of detergent (S131). The display 6 may output a signal indicating the lack of detergent so that a user can easily recognize it.

In case of comparing the obtained difference value with the second predetermined value (S142), when the obtained difference value is less than the second predetermined value, it is determined that an adequate amount of detergent is contained (S143). The display 6 may output a signal indicating that an adequate amount of detergent is accommodated so that a user can easily recognize it (S132).

One of the first and second electrode sensors 301, 301*b* is formed as a receiver and the other is formed as a transmitter. Thus, an electrode sensor formed as a receiver among the first and second electrode sensors 301*a*, 301*b* may receive the first sensor value which is an electric current or an electric voltage from an electrode sensor formed as a transmitter among the first and second electrode sensors 301, 301*b*, and then the third electrode sensor 301*c* may detect the second sensor value which is an electric current from an electrode sensor formed as a transmitter among the first and second electrode sensors 301*a*, 301*b*.

Although the embodiments of the present disclosure are described above with reference to the accompanying drawings, the present disclosure is not limited to the above embodiments, and may be manufactured in various forms, and in the art to which the present disclosure belongs, those skilled in the art will appreciate that the present disclosure may be embodied in other specific forms without changing the technical spirit or essential features of the present disclosure. Therefore, it should be understood that the embodiments described above are exemplary in all respects and not restrictive.

What is claimed is:

1. A washing machine having a cabinet, a tub located inside the cabinet and configured to receive water, a drum rotatably provided inside the tub and configured to accommodate laundry, and a detergent supply device located at the cabinet and configured to supply detergent into the tub, wherein the detergent supply device comprises:

a cartridge configured to receive the detergent;

a first set of electrode sensors disposed at the cartridge and configured to detect an amount of the detergent in the cartridge;

a second set of electrode sensors configured to detect the amount of the detergent in the cartridge and having at least one electrode sensor that is placed vertically higher than the first set of electrode sensors; and a controller electrically connected to the first and second sets of electrode sensors, wherein the washing machine is configured to perform operations comprising:

detecting (i) a first sensor value by the first set of electrode sensors and (ii) a second sensor value by the second set of electrode sensors, comparing the first sensor value and the second sensor value with a first predetermined value, respectively, based on each of the first sensor value and the second sensor value being less than the first predetermined value, allowing a predetermined time to elapse, based on the predetermined time being elapsed, redetecting the first sensor value and the second sensor value and calculating a difference sensor value, the difference sensor value being a difference between the redetected first and second sensor values, and based on the difference sensor value being greater than a second predetermined value, determining that the detergent is filling to a first height between the first set of electrode sensors and the second set of electrode sensors.

2. The washing machine of claim 1, wherein the detergent supply device further comprises a housing that accommodates the cartridge, and wherein the first and second sets of electrode sensors are located at a rear wall of the housing.

3. The washing machine of claim 2, wherein each of the first and second sets of electrode sensors comprises an electrode plate and a terminal that is connected to the electrode plate and that is configured to transmit an electric signal.

4. The washing machine of claim 3, wherein the electrode plate is located at an opening of a rear surface of the cartridge, and wherein the detergent in the cartridge contacts the electrode plate.

5. The washing machine of claim 3, wherein the electrode plate is configured to, based on a determination that the electrode plate contacts the detergent, transmit the electric signal through the terminal.

6. The washing machine of claim 3, wherein the electrode plate is located between a rear wall of the housing and a rear side of the cartridge.

7. The washing machine of claim 3, wherein the terminal is located at a rear wall protrusion of the cartridge and protrudes along a direction perpendicular to the rear wall of the cartridge.

8. The washing machine of claim 1, wherein the operations further comprise, based on the first sensor value being greater than the first predetermined value and the second sensor value being less than the first predetermined value, determining that at least one electrode sensor among the first and second sets of electrode sensors are malfunctioning.

9. The washing machine of claim 1, wherein the operations further comprise, based on each of the first sensor value and the second sensor value being greater than the first predetermined value, determining that the detergent is filling to a height vertically lower than the first set of electrode sensors.

10. The washing machine of claim 1, wherein the operations further comprise, based on the first sensor value being less than the first predetermined value and the second sensor value being greater than the first predetermined value, determining that the detergent is filling to a second height between the first set of electrode sensors and the second set of electrode sensors.

11. The washing machine of claim 1, wherein the first and second sets of electrode sensors comprise first and second electrode sensors located at a same height and a third electrode sensor located vertically higher than the first and second electrode sensors.

12. The washing machine of claim 11, wherein the first set of electrode sensors comprise the first and second electrode sensors, and the second set of electrode sensors comprise (i) the first electrode sensor and the third electrode sensor or (ii) the second electrode sensor and the third electrode sensor; and wherein the height between the first set of electrode sensors and the second set of electrode sensors corresponds to (i) a height between the first electrode sensor and the third electrode sensor or (ii) a height between the second electrode sensor and the third electrode sensor.

13. The washing machine of claim 1, wherein the cartridge is provided in plurality, and wherein the washing machine further comprises:

a passage switching valve connected to at least one of the plurality of cartridges, and a pump connected to the at least one of the plurality of cartridges through the passage switching valve.

* * * * *